US011959338B2

(12) United States Patent
Zillante et al.

(10) Patent No.: US 11,959,338 B2
(45) Date of Patent: Apr. 16, 2024

(54) MULTI-TOOL BORING SYSTEMS AND METHODS OF OPERATING SUCH SYSTEMS

(71) Applicant: ArcByt, Inc., San Francisco, CA (US)

(72) Inventors: Roberto Antonio Zillante, San Francisco, CA (US); Daniel Antonio Zillante, Cambridge, MA (US); Shivani Torres, San Francisco, CA (US)

(73) Assignee: ArcByt, Inc., San Francisco, CA (US)

( * ) Notice: Subject to any disclaimer, the term of this patent is extended or adjusted under 35 U.S.C. 154(b) by 0 days.

(21) Appl. No.: 18/462,311

(22) Filed: Sep. 6, 2023

(65) Prior Publication Data

US 2024/0093557 A1 Mar. 21, 2024

Related U.S. Application Data

(60) Provisional application No. 63/375,829, filed on Sep. 15, 2022.

(51) Int. Cl.
*E21B 19/086* (2006.01)
*E21B 1/12* (2006.01)
(Continued)

(52) U.S. Cl.
CPC ..... *E21B 15/003* (2013.01); *E21B 1/12* (2020.05); *E21B 3/02* (2013.01); *E21B 7/046* (2013.01); *E21B 19/086* (2013.01)

(58) Field of Classification Search
CPC ..... E21B 19/086; E21B 7/046; E21B 1/00; E21B 1/12
See application file for complete search history.

(56) References Cited

U.S. PATENT DOCUMENTS 3,945,443 A * 3/1976 Barnes ..... E21B 7/201 175/122
3,952,813 A 4/1976 Chepurnoi et al.
(Continued)

FOREIGN PATENT DOCUMENTS

CN 2329707 7/1999
CN 102748034 A 10/2012
(Continued)

OTHER PUBLICATIONS

International Application No. PCT/US2019/017198 Form PCT/ISA/210 International Search Report dated Jun. 24, 2019 (18 pages).

*Primary Examiner* — Sean D Andrish
(74) *Attorney, Agent, or Firm* — Polygon IP, LLP

(57) ABSTRACT

Described herein are multi-tool boring systems and methods of operating such systems for tunnel boring and/or underground pipe installation. A multi-tool boring system is specially configured for fast installation and replacement of various tools, such as a pneumatic rammer and a hydraulic drive, enabling different operating modes of the system, e.g., pilot tube installation, auger boring, pipe ramming, pilot pullback boring, static pipe bursting, and non-contact boring. In some examples, a multi-tool boring system comprises a track assembly, a jacking frame slidably supported on the track assembly, and an impact plate assembly, which is attached to the jacking frame and comprises an impact plate and shock absorbers between the impact plate and the jacking frame. The impact plate comprises an impact plate opening configured to engage and support a pneumatic rammer. The rammer can be replaced with a hydraulic drive with a shaft protruding through the opening.

19 Claims, 21 Drawing Sheets

(51) Int. Cl.

| | |
|---|---|
| ***E21B 3/02*** | (2006.01) |
| ***E21B 7/04*** | (2006.01) |
| ***E21B 15/00*** | (2006.01) |

(56) References Cited

U.S. PATENT DOCUMENTS

| | | | | |
|---|---|---|---|---|
| 4,013,134 | A | 3/1977 | Richmond et al. | |
| 4,020,641 | A * | 5/1977 | Takada | E21B 7/046 405/184 |
| 4,553,612 | A | 11/1985 | Durham | |
| 4,671,703 | A | 6/1987 | Schmidt | |
| 4,691,788 | A | 9/1987 | Yoshida et al. | |
| 4,738,565 | A | 4/1988 | Streatfield et al. | |
| 5,076,731 | A | 12/1991 | Luksch | |
| 5,192,165 | A | 3/1993 | Torielli | |
| 5,302,053 | A | 4/1994 | Moriarty | |
| 5,403,122 | A | 4/1995 | Granella | |
| 5,456,552 | A | 10/1995 | Cherrington | |
| 5,480,263 | A | 1/1996 | Kayes | |
| 5,482,404 | A | 1/1996 | Li | |
| RE35,271 | E | 6/1996 | Fisk et al. | |
| 5,628,585 | A | 5/1997 | Li et al. | |
| RE35,542 | E | 6/1997 | Fisk et al. | |
| 5,919,005 | A | 7/1999 | Rupiper | |
| 6,607,044 | B1 * | 8/2003 | Eppink | E21B 17/206 175/320 |
| 6,652,190 | B1 | 11/2003 | Verkyk | |
| 10,539,254 | B2 | 1/2020 | Zillante et al. | |
| 10,584,585 | B2 | 3/2020 | Helming | |
| 10,788,146 | B2 | 9/2020 | Zillante et al. | |
| 11,287,060 | B2 | 3/2022 | Zillante et al. | |
| 11,492,904 | B2 | 11/2022 | Wright et al. | |
| 11,592,457 | B2 | 2/2023 | Wright | |
| 11,598,209 | B2 | 3/2023 | Abrams et al. | |
| 11,608,687 | B2 | 3/2023 | Torres et al. | |
| 2009/0152012 | A1 * | 6/2009 | Salins | E21B 21/12 175/339 |
| 2016/0090831 | A1 * | 3/2016 | Malcolm | E21B 7/20 175/27 |
| 2016/0333642 | A1 | 11/2016 | Bachand et al. | |
| 2017/0342776 | A1 | 11/2017 | Bullock et al. | |
| 2020/0158262 | A1 | 5/2020 | Zillante et al. | |
| 2021/0033216 | A1 | 2/2021 | Zillante et al. | |

FOREIGN PATENT DOCUMENTS

| | | | |
|---|---|---|---|
| CN | 101982688 | B | 11/2012 |
| CN | 106917629 | A | 7/2017 |
| DE | 3513578 | C1 | 3/1986 |

* cited by examiner

A-A in FIG. 3A

MULTI-TOOL BORING SYSTEMS AND METHODS OF OPERATING SUCH SYSTEMS

CROSS-REFERENCE TO RELATED APPLICATIONS

This application claims the benefit under 35 U.S.C. § 119(e) of US Provisional Patent Application 63/375,829, filed on 2022 Sep. 15, which is incorporated herein by reference in its entirety for all purposes.

BACKGROUND

Conventional techniques for tunnel boring and/or underground pipe installation (including pipe replacement) are slow and require multiple different types of complex and expensive equipment. For example, a process may involve pushing a casing (e.g., a pipe) into the ground using one type of equipment (e.g., hydraulic pipe jacks) followed by removing dirt from the casing using another type of equipment (e.g., an auger). Switching from one type of equipment to another type requires significant time (e.g., hours) and can cause various issues (e.g., misalignment of different types of equipment). As a result of these complexities and time requirements, tunnel boring and/or underground pipe installation remains limited.

What is needed are new boring systems and methods such as multi-tool boring systems and methods of operating such systems.

SUMMARY

Described herein are multi-tool boring systems and methods of operating such systems for tunnel boring and/or underground pipe installation. A multi-tool boring system is specially configured for fast installation and replacement of various tools, such as a pneumatic rammer and a hydraulic drive, enabling different operating modes of the system, e.g., pilot tube installation, auger boring, pipe ramming, pilot pullback boring, static pipe bursting, and non-contact boring. In some examples, a multi-tool boring system comprises a track assembly, a jacking frame slidably supported on the track assembly, and an impact plate assembly, which is attached to the jacking frame and comprises an impact plate and a plurality of shock absorbers positioned between the impact plate and the jacking frame. The impact plate comprises an impact plate opening configured to engage and support a pneumatic rammer. The rammer can be replaced with a hydraulic drive with a shaft protruding through the opening.

In some examples, a multi-tool boring system comprises a track assembly comprising two tracks extending parallel to a primary axis of the multi-tool boring system. The multi-tool boring system also comprises a jacking frame, slidably supported on the track assembly, and an impact plate assembly attached to the jacking frame. The impact plate assembly comprises an impact plate and a plurality of shock absorbers positioned between the impact plate and the jacking frame along an outer edge of the impact plate. The impact plate also comprises an impact plate opening defined by an inner edge. The inner edge is configured to engage and support a pneumatic rammer when the pneumatic rammer is attached to the impact plate and partially protrudes into the impact plate opening. In some examples, the inner edge formed a cone-shaped surface symmetrical about the primary axis.

In some examples, the jacking frame comprises a pair of drive-supporting plates, each extending substantially perpendicular to the primary axis. The hydraulic drive is configured to bolt to each of the drive supporting plates when the hydraulic drive is attached to the jacking frame and when the pneumatic rammer is removed from the multi-tool boring system. In more specific examples, each of the pair of drive supporting plates comprises a plate opening. The hydraulic drive protrudes through the plate opening of each of the pair of drive supporting plates when the hydraulic drive is attached to the jacking frame. The pneumatic rammer protrudes through the plate opening of each of the pair of drive-supporting plates when the pneumatic rammer is attached to the impact plate.

In some examples, the impact plate assembly further comprises a plurality of additional shock absorbers and a plurality of supporting bolts. Each of the plurality of supporting bolts protrudes through one of the plurality of additional shock absorbers. Each plurality of additional shock absorbers is positioned closer to the primary axis than any one of the plurality of shock absorbers. The jacking frame comprises a frame plate such that the plurality of shock absorbers and the plurality of additional shock absorbers are disposed between and in contact with each of the impact plate and the frame plate and such that the plurality of supporting bolts are bolted into the frame plate.

In some examples, the impact plate comprises dirt removal passages circumferentially distributed about the primary axis. In more specific examples, the dirt removal passages comprise multiple sets of dirt removal passages having different radial offsets from the primary axis.

In some examples, the impact plate comprises a main plate and one or more rings, all welded together. In the same or other examples, the impact plate comprises a plurality of casing-edge receiving protrusions, each having a circular shape concentric about the primary axis and having a different diameter than any other one of the plurality of casing-edge receiving protrusions. For example, each of the plurality of casing-edge receiving protrusions comprises two side walls, each angled between 3° and 10° relative to the primary axis. In some examples, the angle of one of the two side walls is different from the angle of another one of the two side walls. In the same or other examples, the two side walls extend to a bottom wall. The bottom wall has a width less than the wall thickness of an open-ended casing protruding into a corresponding one of the plurality of casing-edge receiving protrusions.

In some examples, the multi-tool boring system further comprises a hydraulic system attached to the jacking frame and configured to move the jacking frame relative to the track assembly. The hydraulic system comprises a set of primary hydraulic cylinders and a set of secondary hydraulic cylinders, independently actuatable from the set of primary hydraulic cylinders. In some examples, the cylinders' positions in the set of primary hydraulic cylinders are symmetrical with respect to the primary axis. The cylinders' positions in the set of second hydraulic cylinders are symmetrical with respect to the primary axis.

In some examples, the hydraulic system comprises a set of hydraulic hoses and a set of hydraulic connectors, coupled to the set of hydraulic hoses. Each cylindrical interface formed by the set of hydraulic connectors and the set of hydraulic hoses is aligned substantially parallel to the primary axis. In some examples, the hydraulic system comprises a set of hydraulic dampers, each comprising a gas enclosed fluidically coupled to at least the set of primary hydraulic cylinders. In some examples, the hydraulic system further comprises a pressure-relief valve fluidically coupled to a hydraulic drive when the hydraulic drive is attached to the jacking frame.

In some examples, each of the two tracks comprises a set of track units, extending along the primary axis such that each adjacent pair of the set of track units is bolted together. In more specific examples, the track assembly further comprises a set of track support configured to support the two tracks relative to each other and relative to the ground. Each end of each track unit in the set of track units is supported by one in the set of track support.

In some examples, the multi-tool boring system further comprises an anchoring unit configured to form a temporary fixed position on the two tracks. The anchoring unit comprises a bridging frame forming two frame openings such that each of the two tracks extends through one of the two frame openings. The anchoring unit comprises two locking mechanisms.

These and other embodiments are described further below with reference to the figures.

DETAILED DESCRIPTION

Figure 1A:
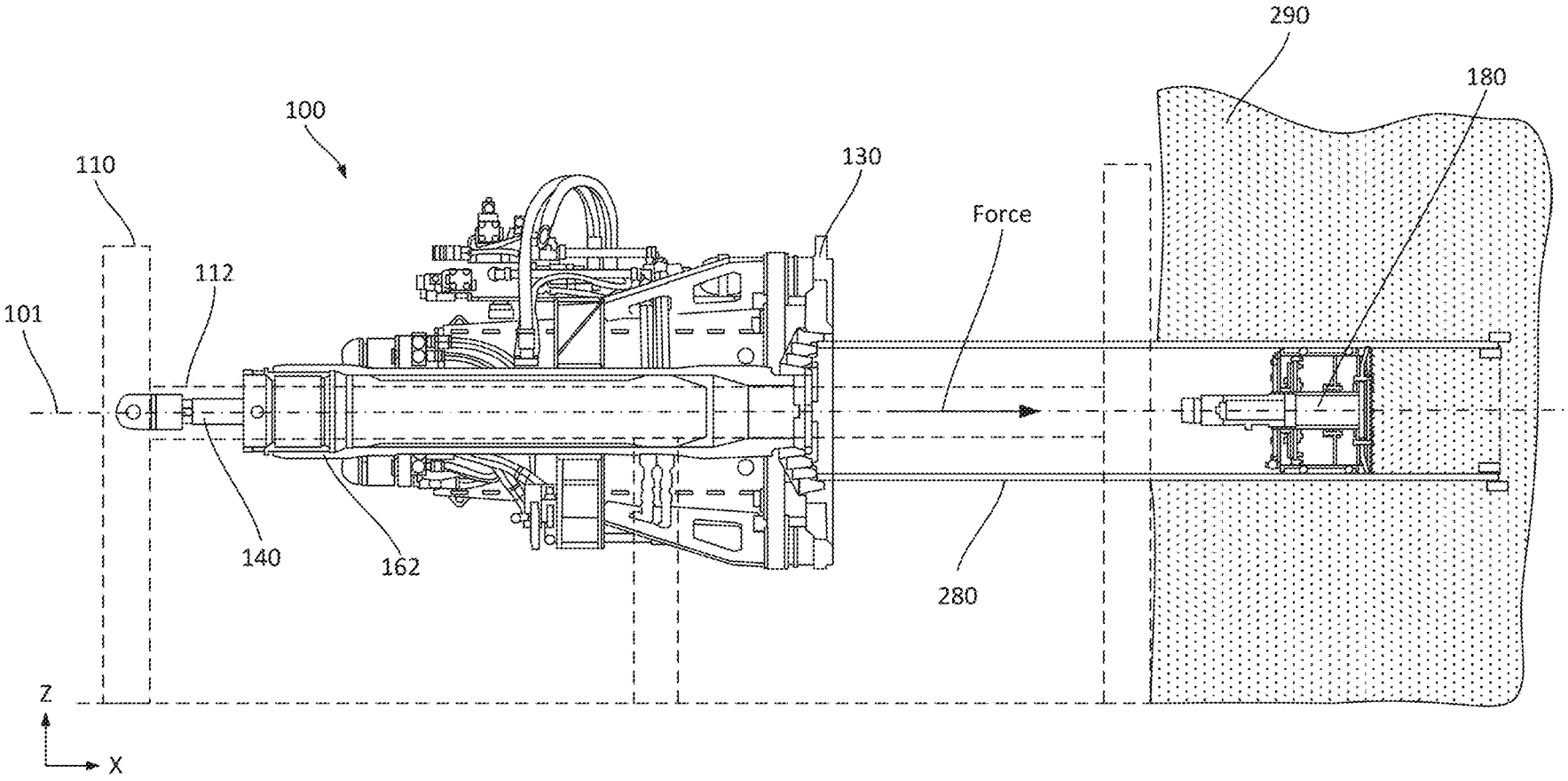
FIGS. 1A-1F are schematic representations of a multi-tool boring system comprising different types of tools designed to perform different boring operations, in accordance with some examples.

In the following description, numerous specific details are outlined in order to provide a thorough understanding of the presented concepts. The presented concepts may be practiced without some or all of these specific details. In other instances, well-known process operations have not been described in detail to not unnecessarily obscure the described concepts. While some concepts will be described in conjunction with the specific embodiments, it will be understood that these embodiments are not intended to be limiting.

Introduction/Multi-Tool Configurations

As noted above, a multi-tool boring system is configured to enable fast installation and replacement of various tools that provide different system configurations. Each configuration may be tailored to a specific operation, such as pipe casing installation using a combination of constant and percussive forces (shown in FIG. 1A), soil removal using an auger (shown in FIG. 1B), a pilot tube installation (shown in FIG. 1C), pilot tube pull back (shown in FIG. 1D), and various forms of non-contact boring (shown in FIGS. 1E and 1F). It is important to note that switching from one configuration to another configuration can be performed often in a matter of minutes or a few hours (vs. days for conventional systems). Furthermore, many components of a multi-tool boring system remain the same in each of these configurations (while conventional systems typically require complete system replacements).

For example, multi-tool boring system 100 comprises track assembly 110, jacking frame 120, impact plate assembly 130, and hydraulic system 140, all of which are present in every configuration of multi-tool boring system 100. Track assembly 110 comprises two tracks 112 extending parallel to primary axis 101 of multi-tool boring system 100. Jacking frame 120 is slidably supported on track assembly 110. Impact plate assembly 130 is attached to jacking frame 120. In some examples, multi-tool boring system 100 comprises a system controller 109 for controlling the operation of the hydraulic system 140 and various boring tools 160 (e.g., pneumatic rammer 162, hydraulic drive 170).

In some examples, the system controller 109 comprises a processor and memory, e.g., storing various operational aspects described below. For example, the processor can be configured to actuate pneumatic rammer 162 and/or hydraulic drive 170, e.g., determine the timing, speed, and other parameters of their operation. In some examples, system controller 109 also comprises a communication interface, e.g., to communicate with one or more external devices, such as a remote computing system. The communication may take place via the Internet or another communication medium. The remote computing system may be configured to receive the operating parameters from the system controller 109 or, more specifically, the operating parameters of various components of the multi-tool boring system 100.

Figure 2A:
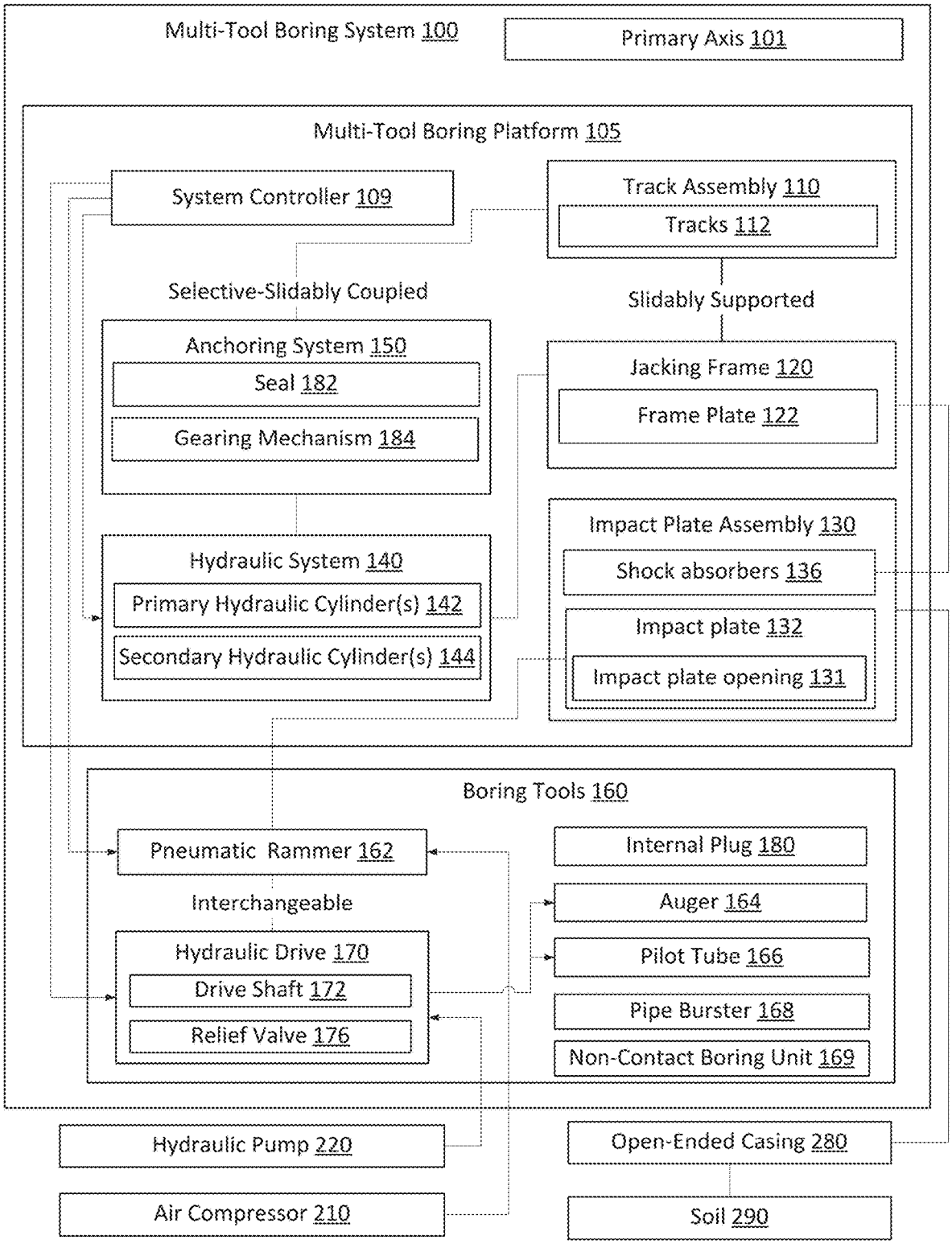
FIG. 2A is a schematic block diagram of a multi-tool boring system illustrating various components of the systems and connections among these components, in accordance with some examples.

FIG. 2A also illustrates tools that are external to multi-tool boring system 100 but which are used for various operations of multi-tool boring system 100. For example, FIG. 2A illustrates hydraulic pump 220, which can be fluidically connected to and used to power the hydraulic drive 170. FIG. 2A also illustrates air compressor 210, which can be fluidically connected to and used to power the pneumatic rammer 162.

Referring to FIG. 1A, which illustrates the installation of open-ended casing 280 into soil 290, multi-tool boring system 100 further comprises pneumatic rammer 162, which is supported by impact plate assembly 130. Impact plate assembly 130 engages one end of open-ended casing 280 and applies a combination of constant and percussive forces. Specifically, the constant force is applied by hydraulic system 140, while the percussive force is applied by pneumatic rammer 162. Both types of forces are applied through impact plate assembly 130, which engages both hydraulic system 140 and pneumatic rammer 162.

Figure 1B:
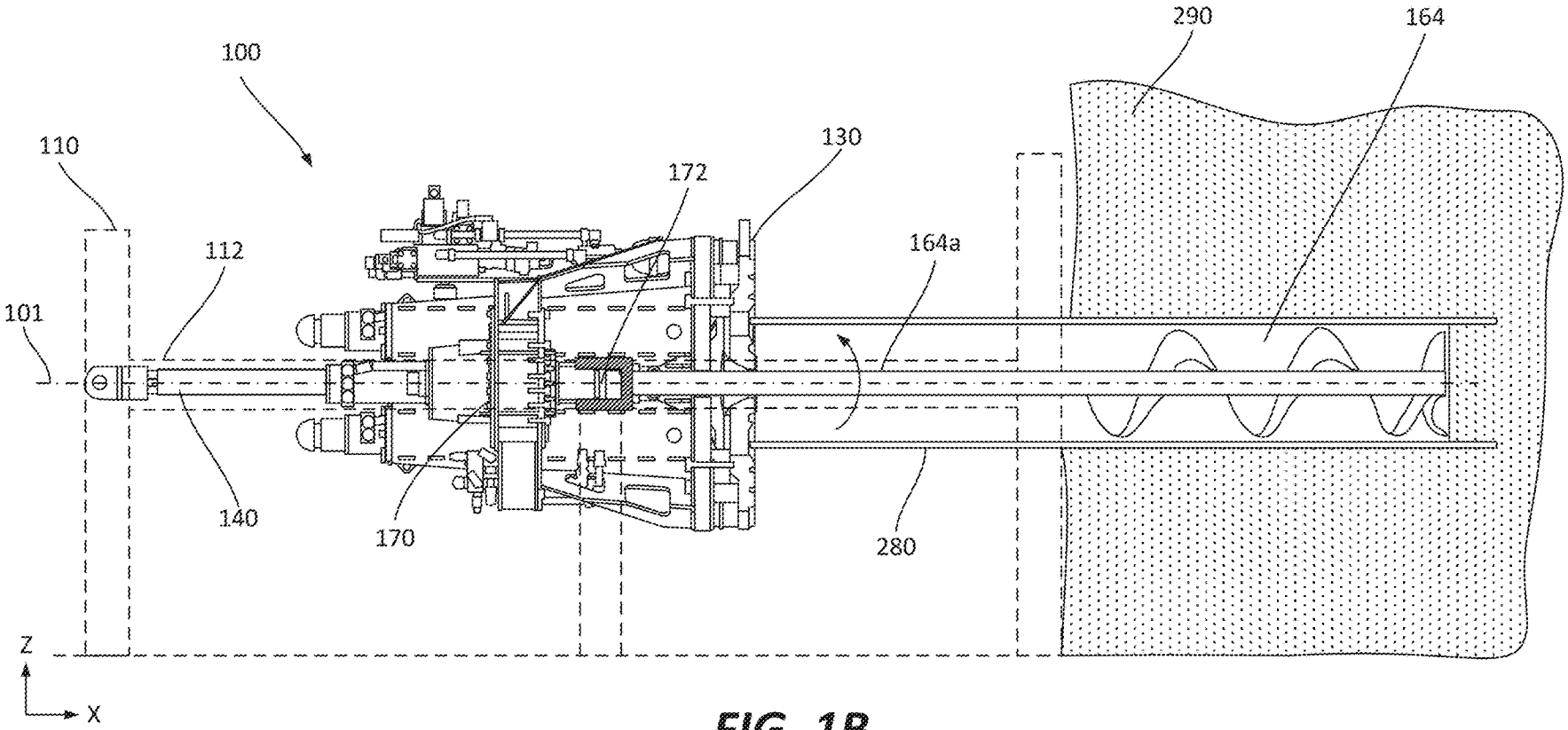

Referring to FIG. 1B, which illustrates the soil removal, multi-tool boring system 100 now comprises hydraulic drive 170, which replaces pneumatic rammer 162. Hydraulic drive 170 is coupled to auger shaft 164*a*, which is also coupled to auger 164. In this configuration, auger shaft 164*a* protrudes through impact plate assembly 130. When open-ended casing 280 is present in this configuration, impact plate assembly 130 can provide a constant force onto open-ended casing 280 using hydraulic system 140. Hydraulic drive 170 rotates auger 164 thereby displacing soil toward the bore entrance. The position of auger 164 within the bore can be controlled by hydraulic system 140. Specifically, hydraulic system 140 moves jacking frame 120, which, in turn, pushes and/or pulls auger shaft 164*a* and auger 164 along principal axis 101.

It should be noted that changing from the casing installation configuration in FIG. 1A to the soil removing configuration in FIG. 1B involves (a) removing pneumatic rammer 162, (b) attaching hydraulic drive 170 to jacking frame 120, (c) protruding auger shaft 164*a* through impact plate assembly 130, and coupling to hydraulic drive 170. All these operations can be performed in under an hour. It should be also noted that track assembly 110, jacking frame 120, impact plate assembly 130, and hydraulic system 140 remain and are not only used to provide new functionality (associated with a new configuration) but are also used to maintain the reference to the boring tunnel (e.g., cross-alignment between different tools associated with different configurations).

Figure 1C:
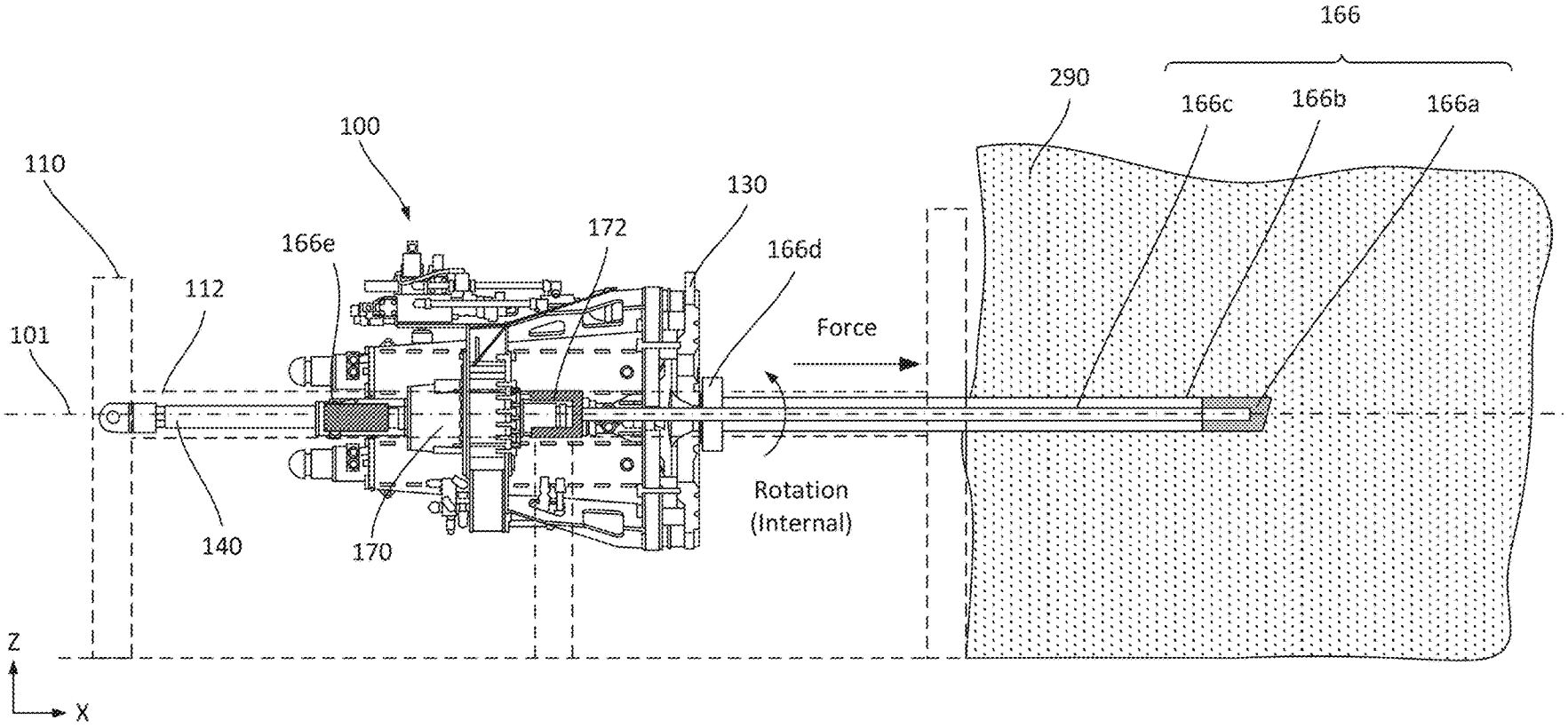

Referring to FIG. 1C, which illustrates the installation of pilot tube 166, multi-tool boring system 100 also comprises hydraulic drive 170. In some examples, pilot tube 166 comprises pilot head 166*a*, pilot outer tube 166*b*, and pilot inner tube 166*c*. Pilot outer tube 166*b* can be connected to impact plate assembly 130 (e.g., using pilot tube attachment plate 166*d*) such that impact plate assembly 130 can push and pull pilot outer tube 166*b* (and, as a result, pilot head 166*a*) along primary axis 101. Pilot inner tube 166*c* protrudes through impact plate assembly 130 and is coupled to hydraulic drive 170 or, more specifically, to drive shaft 172 of hydraulic drive 170. Hydraulic drive 170 can rotate pilot inner tube 166*c* and, as a result, pilot head 166*a*, which effectively steers pilot head 166*a* within soil 290. In some examples, multi-tool boring system 100 also comprises optical inspection system 166*e*, which determines the axial offset of pilot head 166*a* relative to jacking frame 120 or, more generally, relative to primary axis 101. Optical inspection system 166*e* can be positioned behind hydraulic drive 170 (attached to hydraulic drive 170 or to jacking frame 120) and have a line of sight through hydraulic drive 170 and pilot inner tube 166*c* all the way to pilot head 166*a*.

Figure 1D:
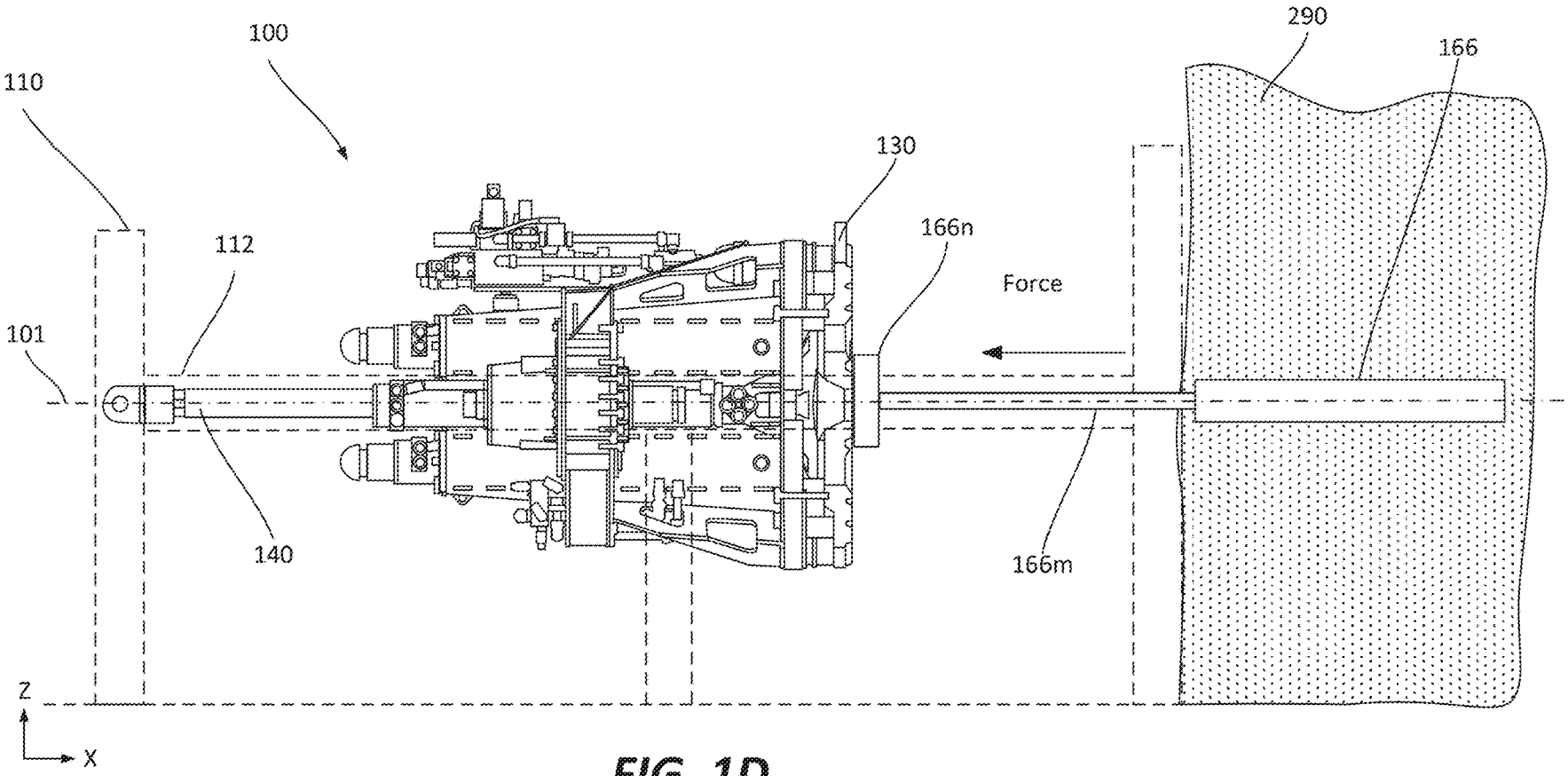

Referring to FIG. 1D, which illustrates the pullback of pilot tube 166, multi-tool boring system 100. In this example, pilot tube 166 is fed from another side (opening) of the bore and is pulled to multi-tool boring system 100 using pull shaft 166*m*. Specifically, the pull shaft 166*m* is connected to both pilot tube 166 and impact plate assembly 130 (e.g., using shaft attachment plate 166*n*). Impact plate assembly 130 is pulled away from the bore opening using hydraulic system 140 and pulls pilot tube 166 toward that bore opening. In this configuration, multi-tool boring system 100 does not require a pneumatic rammer 162 or hydraulic drive 170, but either one of these tools can be present.

Figure 1E:
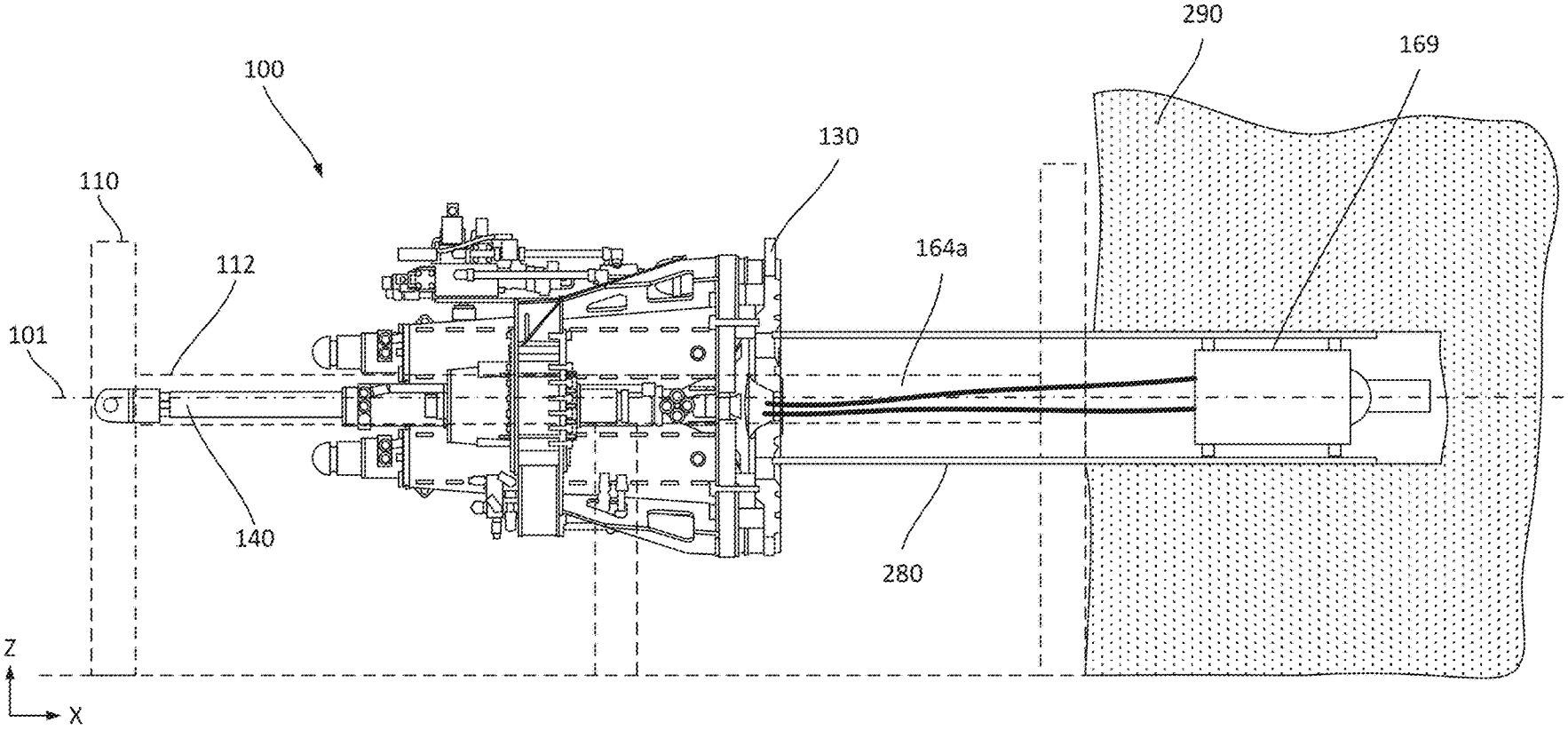
Figure 1F:
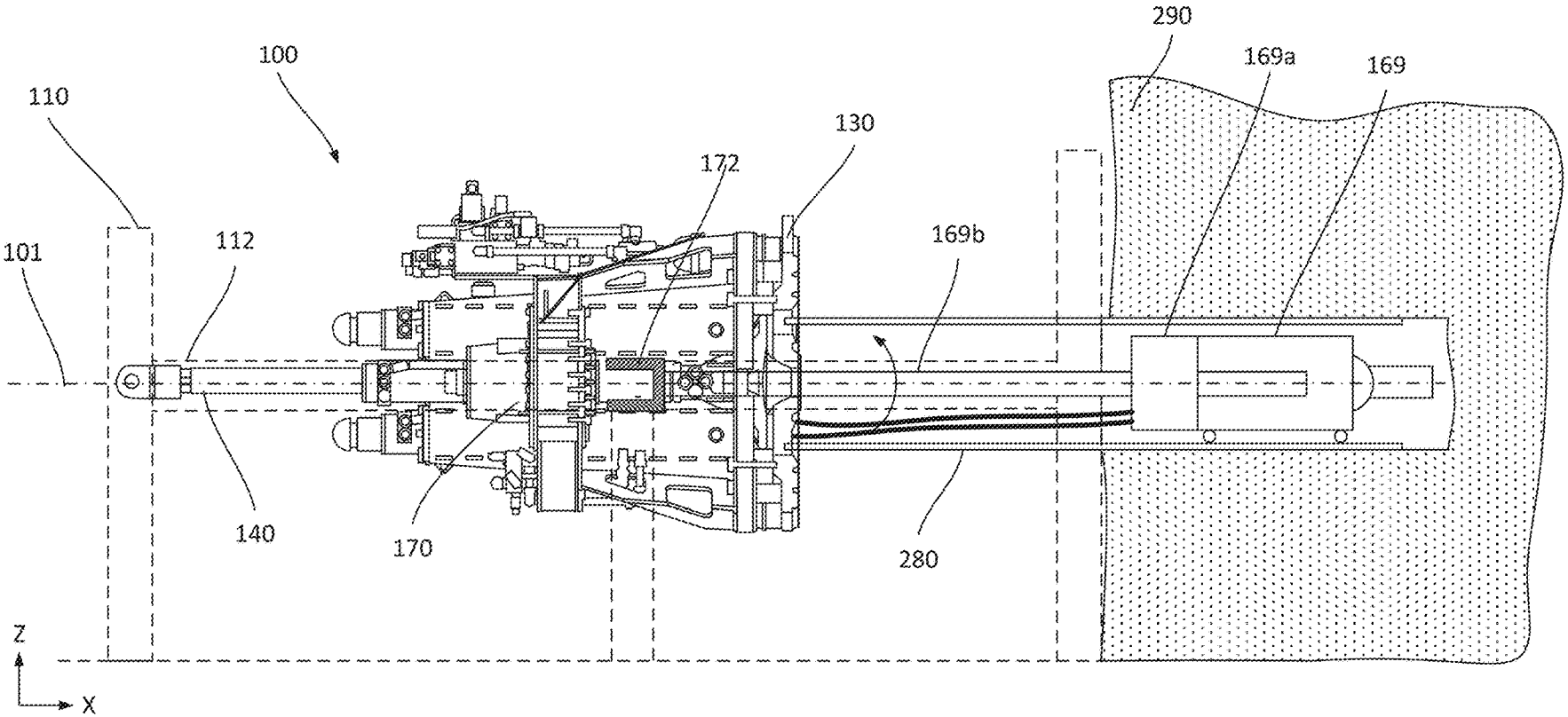

Referring to FIGS. 1E and 1F, multi-tool boring system 100 can be used for non-contact boring that uses, e.g., plasma boring, jet boring, microwave boring, and other like boring techniques. In this configuration, multi-tool boring system 100 comprises non-contact boring tool 169, which can advance within the bore together with open-ended casing 280 (e.g., as shown in FIG. 1E) or independently from open-ended casing 280 (e.g., as shown in FIG. 1F). For example, open-ended casing 280 can be pushed into the bore using impact plate assembly 130 or, more specifically, using hydraulic system 140 operable on impact plate assembly 130. In FIG. 1E, non-contact boring tool 169 has a set position within open-ended casing 280 and is pushed together with open-ended casing 280. Overall, hydraulic system 140 is responsible for the positioning of the non-contact boring tool 169 within the bore and relative to the bore face (which is an important characteristic of non-contact boring). In FIG. 1F, the position of non-contact boring tool 169 is controlled independently from the position of open-ended casing 280. The position of open-ended casing 280 is controlled in the same manner as in FIG. 1E, e.g., by pushing open-ended casing 280 with impact plate assembly 130. However, the position of the non-contact boring tool 169 within the bore and relative to open-ended casing 280 is controlled by positioning device 169*a*, which is coupled to hydraulic drive 170 by positioning shaft 169*b*. Specifically, positioning device 169*a* is configured to change the linear position of positioning device 169*a* (and that of non-contact boring tool 169) in response to the angular position changes of positioning shaft 169*b* (which are controlled by hydraulic drive 170).

Examples of Multi-Tool Boring Systems

FIG. 2A is a schematic block diagram of multi-tool boring system 100 illustrating various components of the systems and connections among these components, in accordance with some examples. Conceptually, multi-tool boring system 100 can be divided into multi-tool boring platform 105 and a set of boring tools 160 that are selectively attached to multi-tool boring platform 105 to form multi-tool boring system 100. Depending on the selected tools (that are attached to multi-tool boring platform 105 and form multi-tool boring system 100), multi-tool boring system 100 can have different configurations and perform different operations as described above with reference to FIGS. 1A-1F.

Various features of multi-tool boring platform 105 or, more specifically, of various components forming multi-tool boring platform 105 enable rapid and very efficient change of these boring tools 160 (e.g., pneumatic rammer 162, hydraulic drive 170, internal plug 180, auger 164, pilot tube 166, pipe burster 168, non-contact boring tool 169). In some examples, the reconfiguration of multi-tool boring system 100 by removing some tools and/or adding other tools can be performed in less than an hour or even within 30 minutes or, in more specific examples, within 15 minutes. It should be noted that multi-tool boring platform 105 remains part of multi-tool boring system 100 regardless of the system configuration/tools attached to multi-tool boring platform 105. This feature distinguishes multi-tool boring system 100 from conventional systems where each system has a specific fixed configuration and where the entire system is replaced when a new configuration/functionality is needed.

Figure 2B:
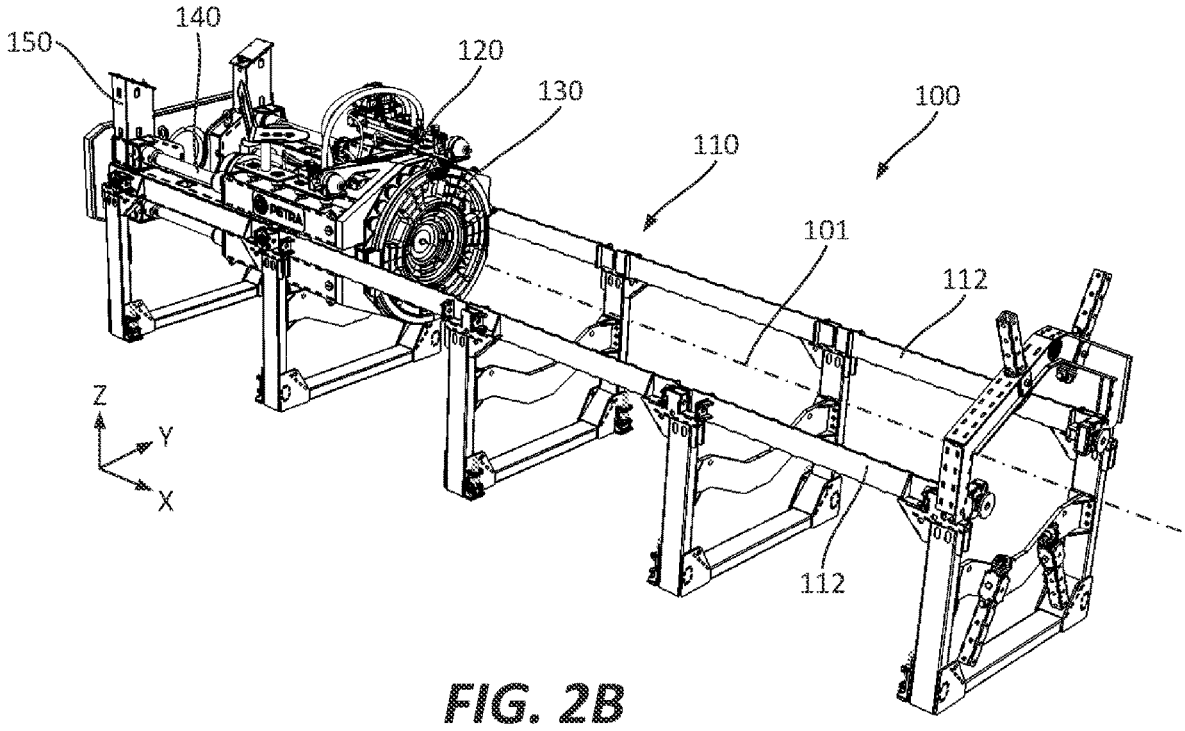
FIG. 2B is a schematic perspective view of a multi-tool boring system, in accordance with some examples.

Referring to FIG. 2A, in some examples, multi-tool boring system 100 comprises track assembly 110 comprising two tracks 112 extending parallel to primary axis 101 of multi-tool boring system 100 as, e.g., is schematically shown in FIG. 2B. For example, primary axis 101 can be positioned between two tracks 112 such that two tracks 112 are symmetric relative to primary axis 101. Various symmetrical aspects of multi-tool boring system 100 further described below help with the load distribution within multi-tool boring system 100.

Multi-tool boring system 100 also comprises jacking frame 120 slidably supported on track assembly 110. In other words, jacking frame 120 can slide on track assembly 110 or, more specifically, on two tracks 112 along primary axis 101. Various features of jacking frame 120 can be symmetrical relative to primary axis 101 as further described below. Furthermore, jacking frame 120 is used to support various components of multi-tool boring system 100, such as boring tools 160 and/or various components of multi-tool boring platform 105.

Figure 2C:
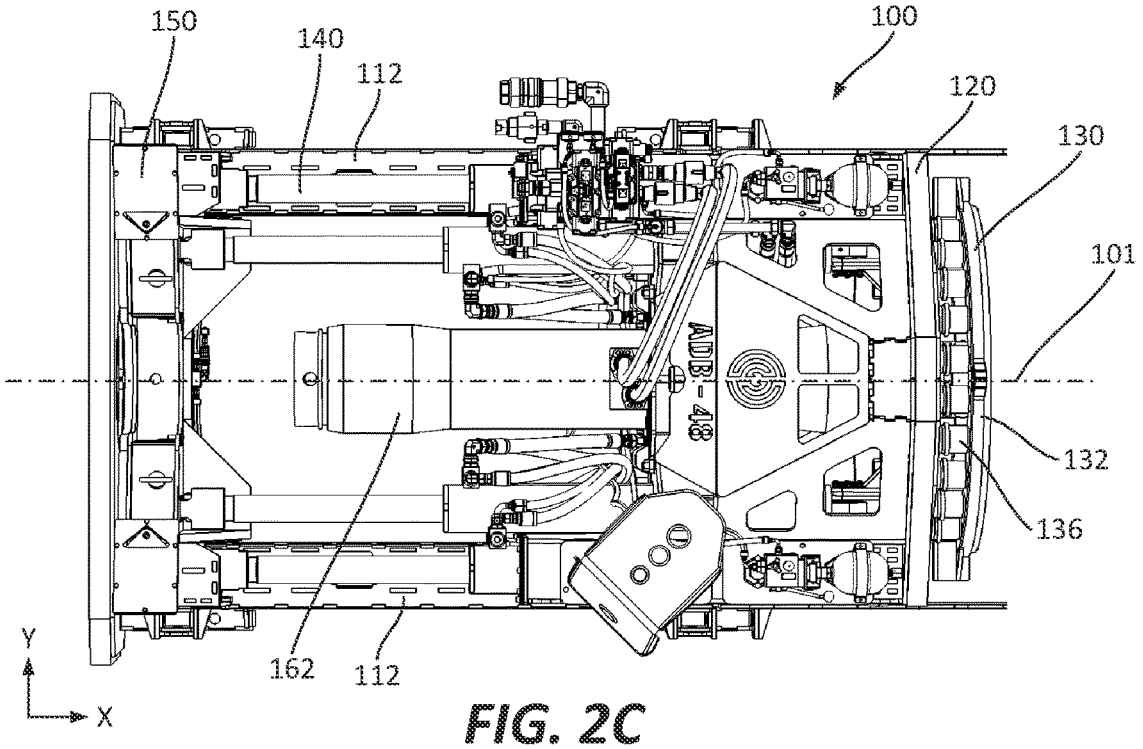
FIG. 2C is a schematic top view of a portion of the multi-tool boring system in FIG. 2B, illustrating a pneumatic rammer being a part of the system, in accordance with some examples.

Multi-tool boring system 100 also comprises impact plate assembly 130 attached to jacking frame 120. Impact plate assembly 130 comprises impact plate 132 and a plurality of shock absorbers 136, e.g., as schematically shown in FIG. 2C as well as FIGS. 3A and 3B. Shock absorbers 136 are positioned between impact plate 132 and jacking frame 120 along the outer edge 133*a* of impact plate 132. Shock absorbers 136 help to reduce the impact force transfer from impact plate 132 to jacking frame 120 thereby preserving the longevity of jacking frame 120 and its components.

Figure 3A:
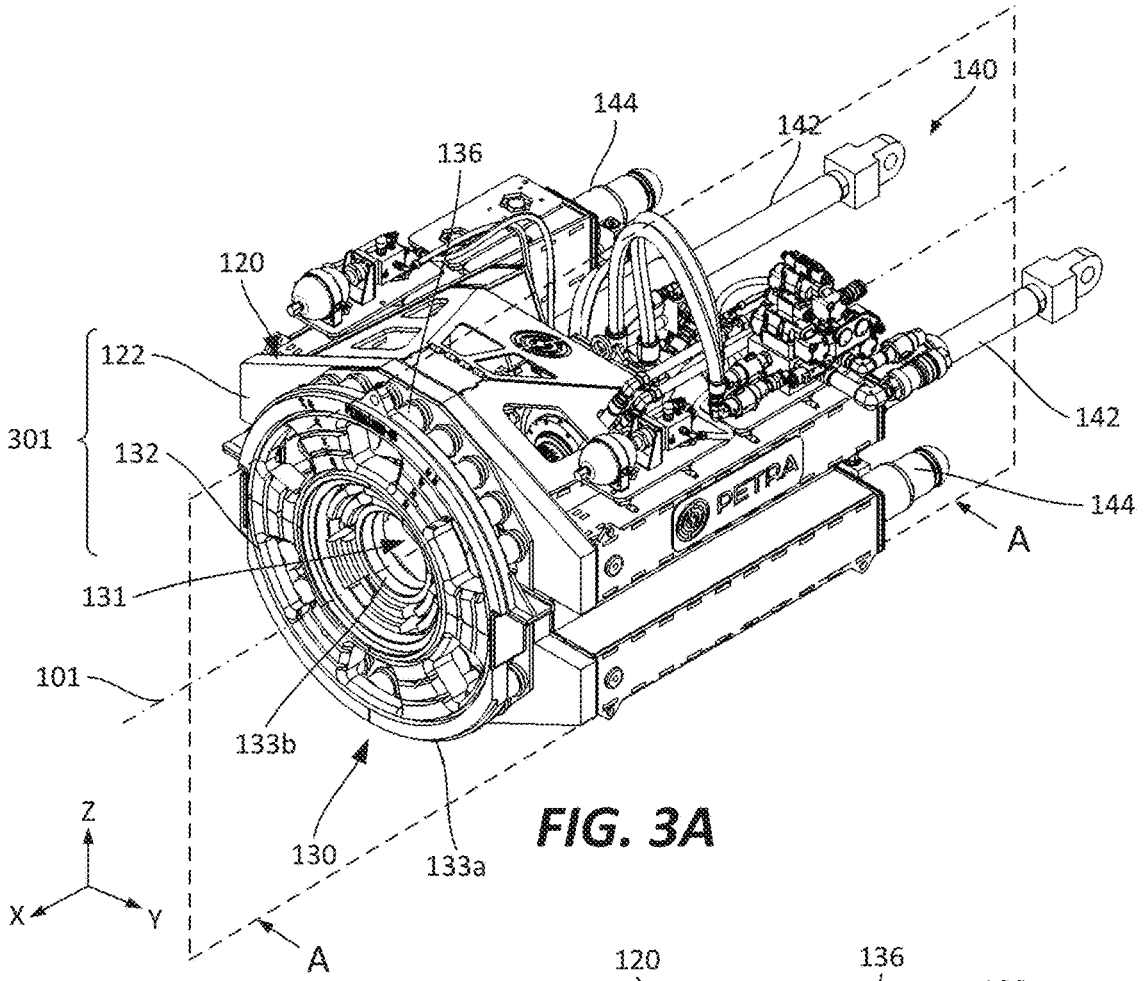
FIG. 3A is a schematic perspective front view of an assembly comprising a jacking frame, an impact plate assembly, and a hydraulic system, in accordance with some examples.
Figure 3B:
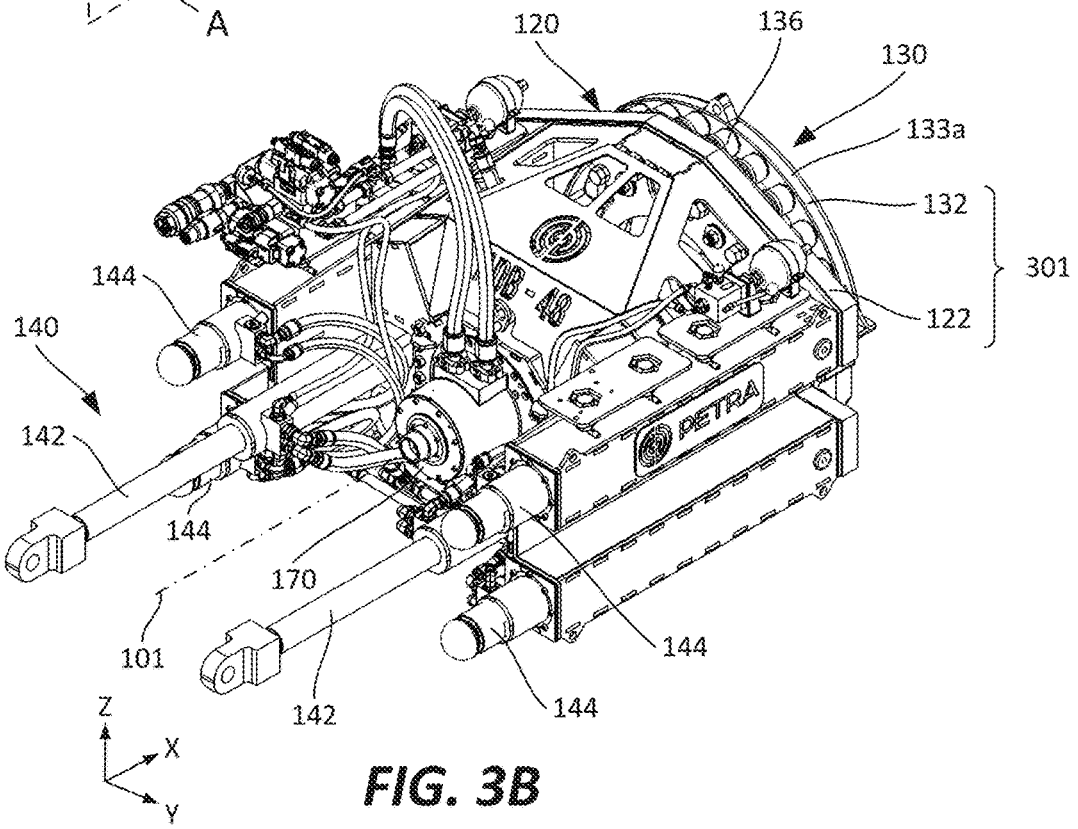
FIG. 3B is a schematic perspective back view of the assembly in FIG. 3A, illustrating a hydraulic drive being a part of the assembly, in accordance with some examples.
Figure 5A:
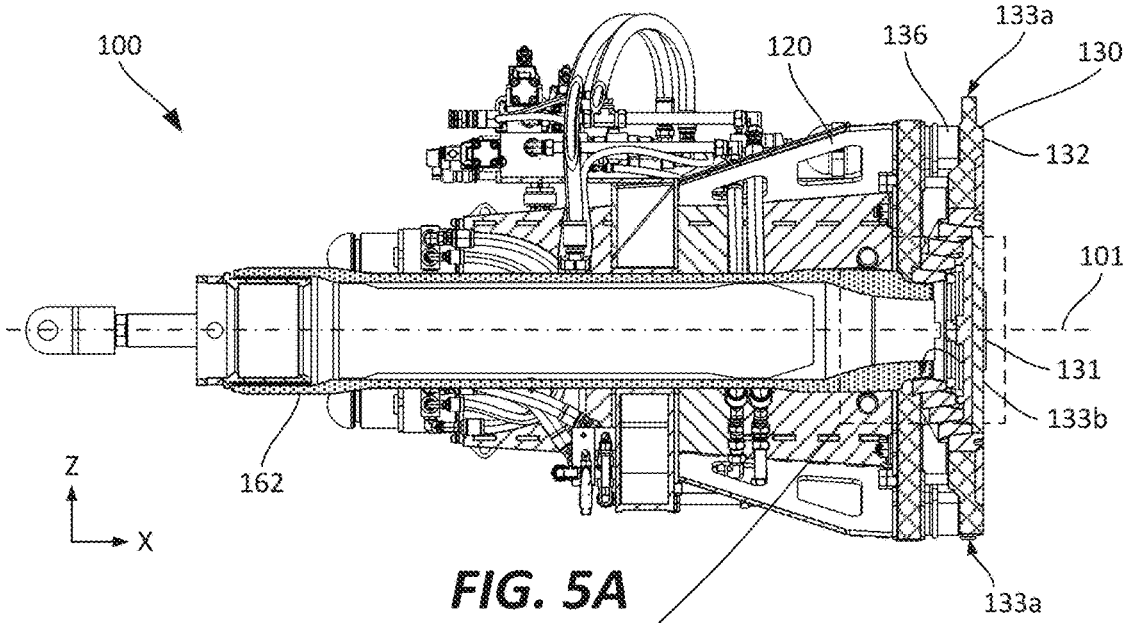
FIG. 5A is a schematic side cross-sectional view of an assembly comprising a jacking frame, an impact plate assembly, and a pneumatic rammer, illustrating the pneumatic rammer being attached to and supported by the impact plate assembly, in accordance with some examples.
Figure 5B:
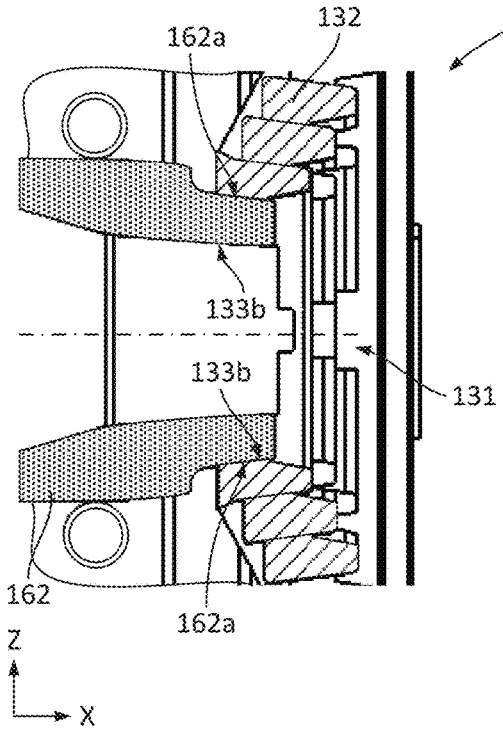
FIGS. 5B and 5C are schematic side cross-sectional views of portions of the impact plate and the pneumatic rammer in an engaged state (FIG. 5B) and in a disengaged state (FIG. 5C), in accordance with some examples.
Figure 5C:
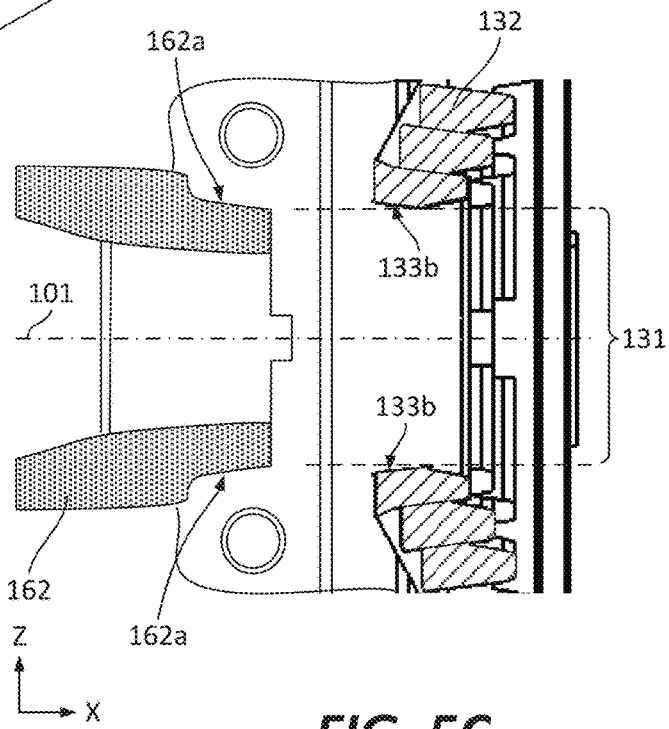

Referring to FIG. 3A, in some examples, impact plate 132 comprises impact plate opening 131 defined by inner edge 133*b*. Impact plate opening 131 is used for protruding various components through impact plate 132 (e.g., a shaft for rotating an auger or a pilot tube) and/or to support various components. Referring to FIGS. 5A-5C, in some examples, inner edge 133*b* of impact plate 132 is configured to engage and support pneumatic rammer 162 when pneumatic rammer 162 is attached to impact plate 132 and partially protrudes into impact plate opening 131. For example, pneumatic rammer 162 may include rammer support surface 162*a* on the leading end, which is inserted into impact plate opening 131. Rammer support surface 162*a* may conform to inner edge 133*b*. In some examples, pneumatic rammer 162 is activated in a forward direction (i.e., in the direction of the X-axis) during the installation to further protrude into impact plate opening 131 and ensure sufficient supporting contact between Rammer support surface 162*a* and inner edge 133*b*. Pneumatic rammer 162 is effectively self-rammed into impact plate opening 131. During the removal of pneumatic rammer 162, pneumatic rammer 162 can be turned on in a reverse direction (i.e., in the direction opposite of the X-axis), which will push pneumatic rammer 162 out of impact plate opening 131. As such, this type of attachment and removal of pneumatic rammer 162 can be performed in a short time (usually minutes). Referring to FIG. in some examples, inner edge 133*b* formed a cone-shaped surface symmetrical about primary axis 101.

Figure 6A:
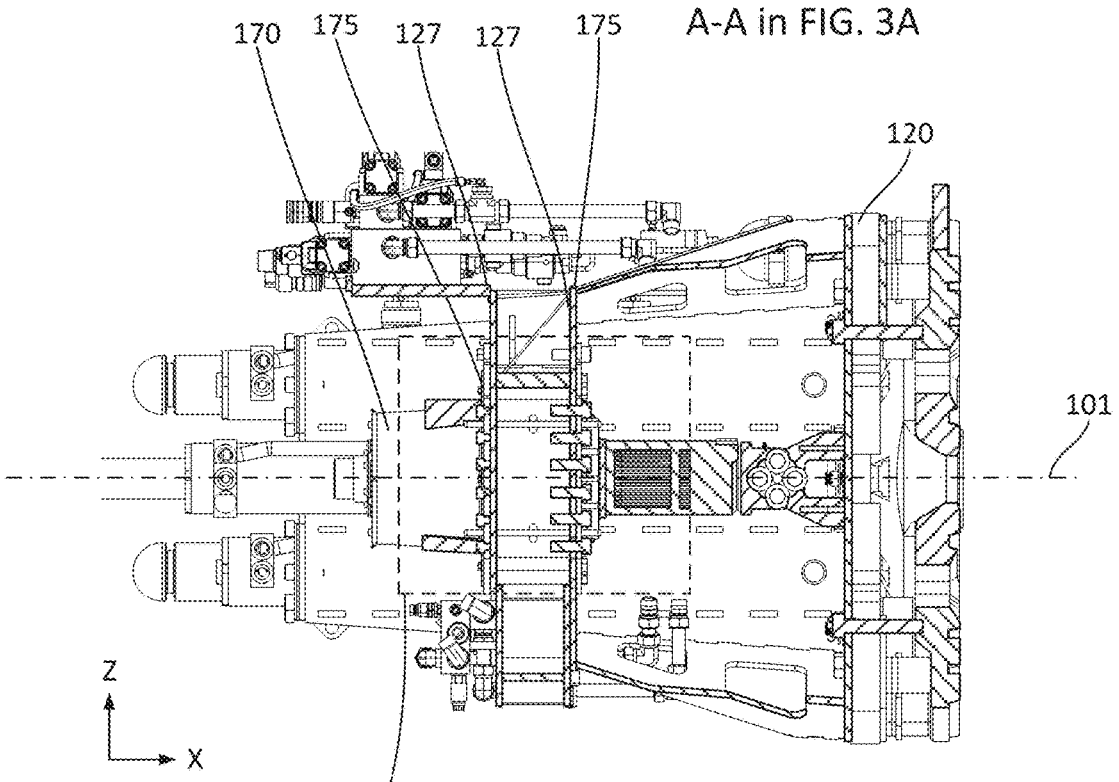
FIG. 6A is a schematic side cross-sectional view of an assembly comprising a jacking frame, an impact plate assembly, and a hydraulic drive, illustrating the hydraulic drive, being attached to and supported by the jacking frame, in accordance with some examples.
Figure 6B:
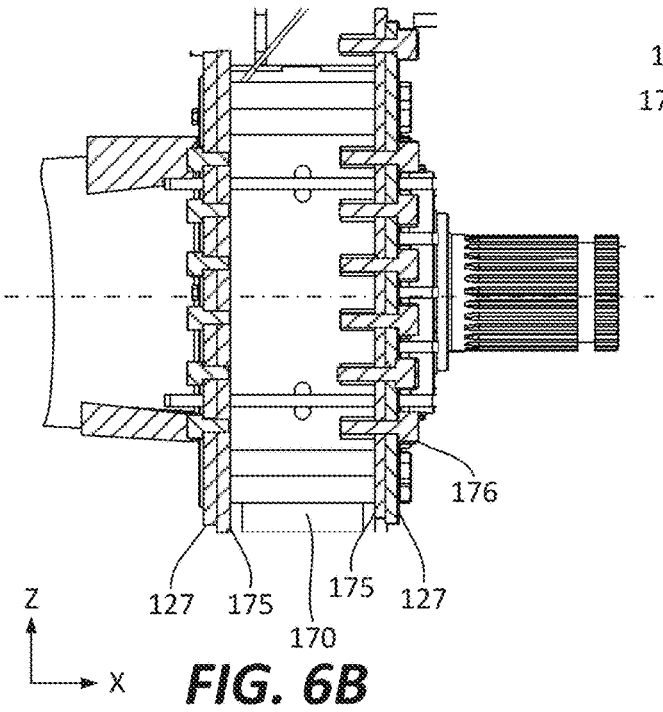
FIG. 6B is an expanded cross-sectional view of portions of the jacking frame and the hydraulic drive in FIG. 6A, illustrating the attachment points between these components, in accordance with some examples.
Figure 6C:
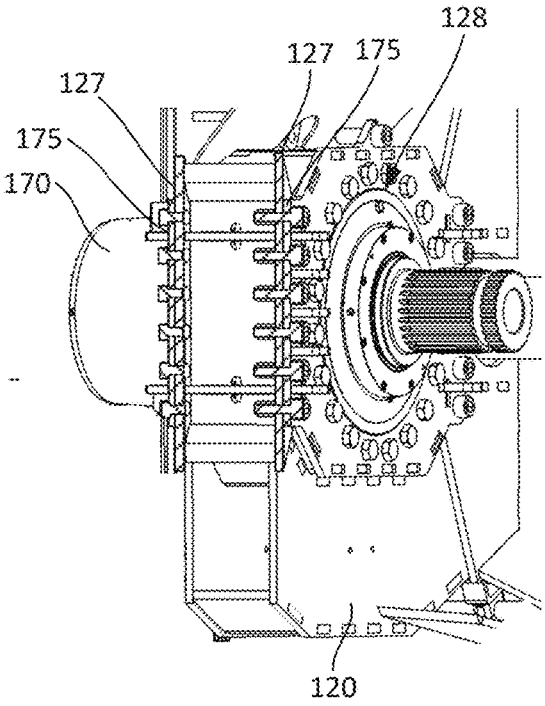
FIG. 6C is an expanded perspective view of the hydraulic drive attached to the jacking frame, in accordance with some examples.

Referring to FIGS. 6A-6C, in some examples, jacking frame 120 comprises a pair of drive supporting plates 127, each extending substantially perpendicular to primary axis 101. Hydraulic drive 170 is configured to bolt to each of the drive supporting plates 127 when hydraulic drive 170 is attached to jacking frame 120. It should be noted that hydraulic drive 170 and pneumatic rammer 162 can be a part of the multi-tool boring system 100 one at a time. For example, in order to attach hydraulic drive 170 to jacking frame 120, pneumatic rammer 162 is first removed from multi-tool boring system 100.

In more specific examples, each drive supporting plate 127 comprises plate opening 128. Hydraulic drive 170 protrudes through plate opening 128 of each drive supporting plate 127 when hydraulic drive 170 is attached to jacking frame 120 as shown in FIGS. 6A-6C. Similarly, pneumatic rammer 162 protrudes through plate opening 128 when pneumatic rammer 162 is attached to impact plate 132. In other words, plate opening 128 enables the installation of different types of tools.

Figure 6D:
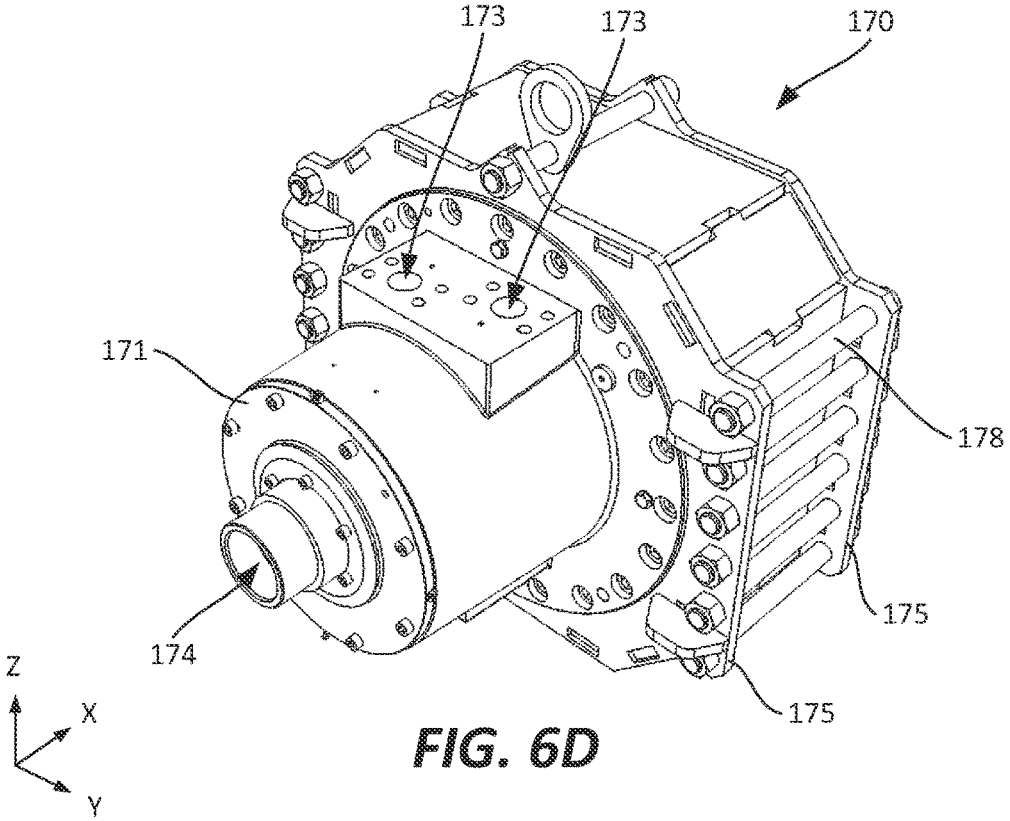
FIG. 6D is a schematic back perspective view of a hydraulic drive, in accordance with some examples.
Figure 6E:
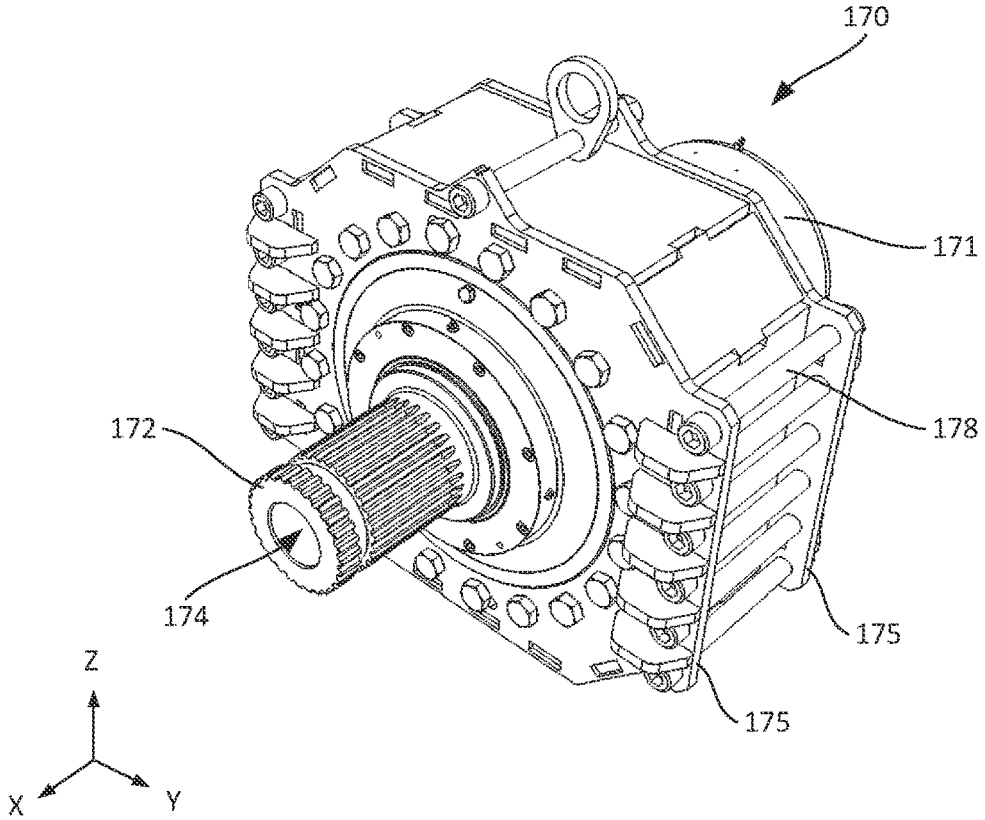
FIG. 6E is a schematic front perspective view of a hydraulic drive, in accordance with some examples.

Referring to FIGS. 6D and 6E, in some examples, hydraulic drive 170, which can be coupled to drive supporting plate 127. For example, hydraulic drive 170 may comprise hydraulic motor 171 comprising motor fluid ports 173, through which hydraulic fluid is pumped to rotate the shaft 172 of the hydraulic motor 171. Hydraulic motor 171 may also be equipped with a pressure relief valve 176. Hydraulic motor 171 may be supported using motor plates 175 with motor fasteners 178 extending between motor plates 175 thereby supporting the motor plates 175 relative to each other and supporting the hydraulic motor 171 between the motor plates 175. Shaft 172 may have passthrough opening 174 for protruding various components through hydraulic motor 171 and/or performing optical measurements.

Referring to FIGS. 4A-4F, impact plate assembly 130 comprises various features to deliver the constant and percussive forces to casing/pipe while providing at least partial isolation to other system components, e.g., jacking frame 120 from at least the percussive forces. As noted above, impact plate assembly 130 comprises a plurality of shock absorbers 136 positioned along the outer edge 133*a* of impact plate 132. In some examples, impact plate assembly 130 further comprises a plurality of additional shock absorbers 137 and a plurality of supporting bolts 138. Each supporting bolt 138 protrudes through one of the additional shock absorbers 137 and engages jacking frame 120 or, more specifically, a threaded opening in frame plate 122 of jacking frame 120. As such, supporting bolts 138 are used for supporting impact plate assembly 130 relative to jacking frame 120 and maintain a set compression in shock absorbers 136 and additional shock absorbers 137. In some examples, each additional shock absorber 137 is positioned closer to primary axis 101 than any shock absorber 136. This radial offset enhances the percussive force isolation.

As noted above, jacking frame 120 comprises frame plate 122. The plurality of shock absorbers 136 and the plurality of additional shock absorbers 137 are disposed between and in contact with each impact plate 132 and frame plate 122 for the percussive force isolation. A combination of impact plate 132 and frame plate 122 may be referred to as a double-plate 301.

Figure 4A:
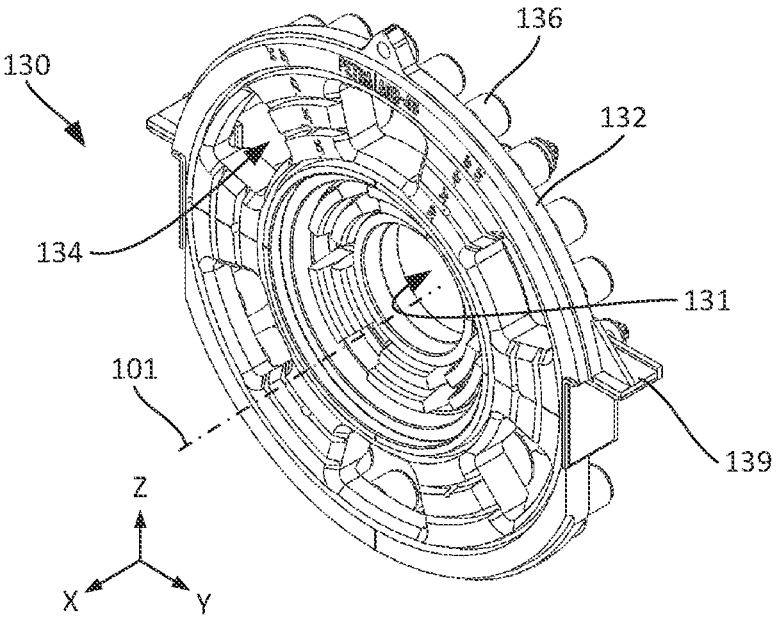
FIG. 4A is a schematic perspective view of an impact plate assembly, illustrating a central impact plate opening and dirt removal passages, in accordance with some examples.
Figure 4B:
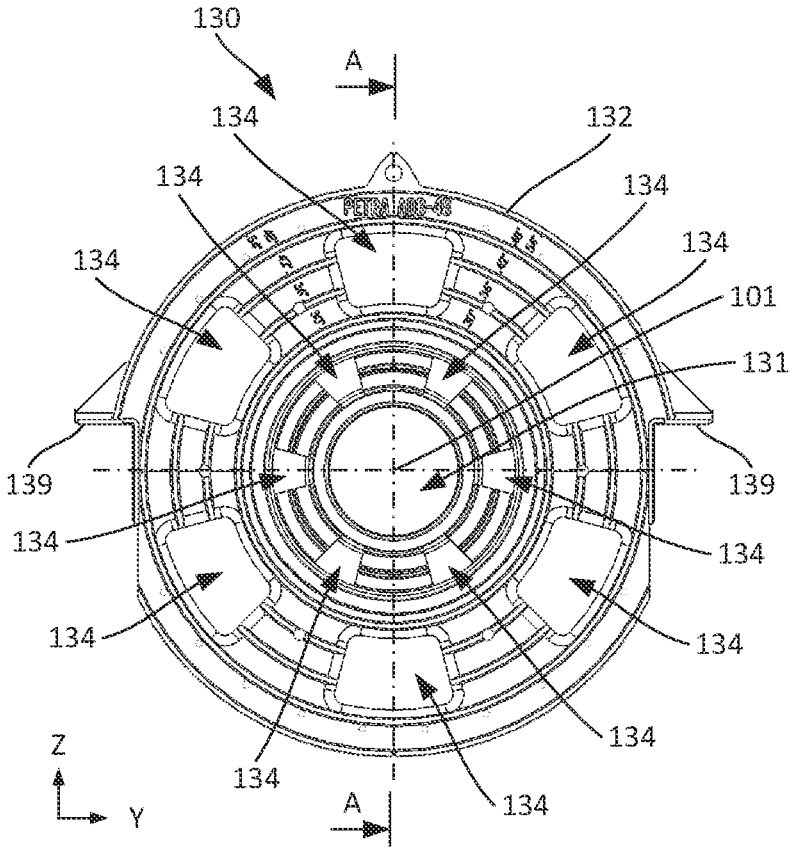
FIG. 4B is a schematic front view of the impact plate assembly in FIG. 4A, in accordance with some examples.
Figure 4C:
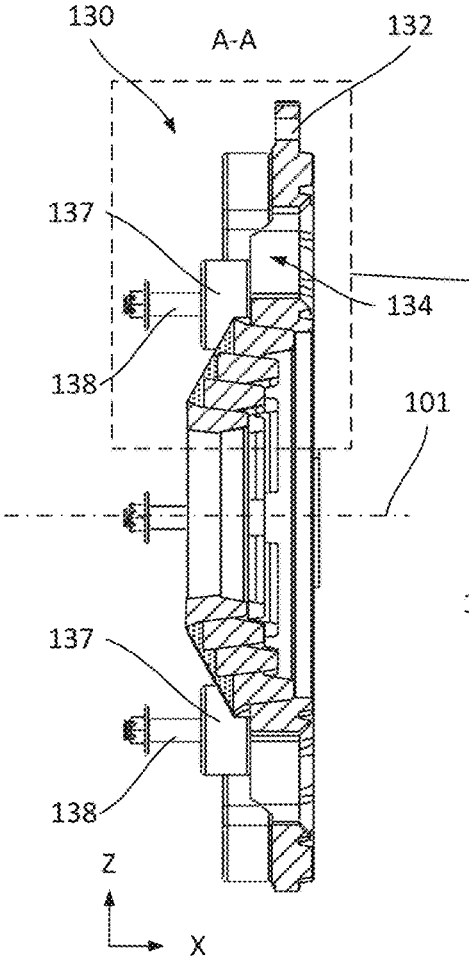
FIG. 4C is a schematic side cross-sectional view of the impact plate assembly in FIG. 4A, in accordance with some examples.

Referring to FIG. 4B, in some examples, impact plate 132 comprises dirt removal passages 134 circumferentially distributed about primary axis 101. Dirt removal passages 134 comprise multiple sets of dirt removal passages 134 having different radial offsets from primary axis 101. For example, FIG. 4B illustrates six dirt removal passages 134 offset a first distance from primary axis 101 (and may be referred to as the first set of dirt removal passages) and another six dirt removal passages 134 offset a second distance from primary axis 101, larger than the first distance (and may be referred to as the second set of dirt removal passages). Furthermore, in some examples, dirt removal passages in the first set may be angular offset from dirt removal passages in the second set, e.g., as shown in FIG. 4B. These radial and angular offsets ensure an even distribution of dirt removal passages throughout the surface of impact plate 132.

Figure 4D:
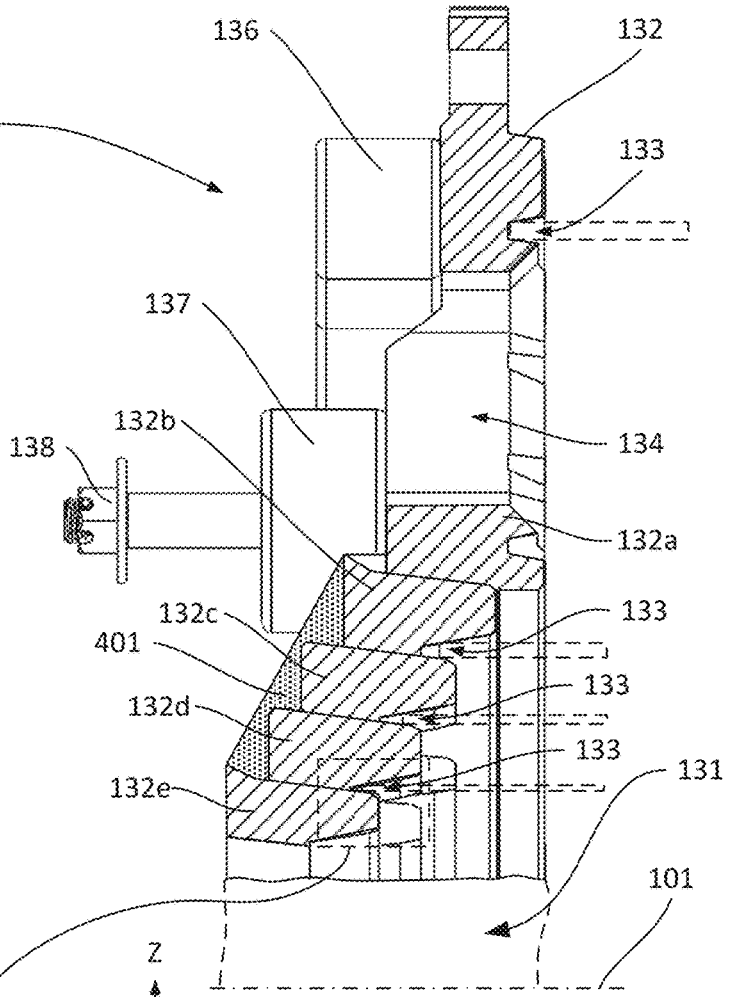
FIG. 4D is an expanded view of a portion of the impact plate assembly shown in FIG. 4C, illustrating different parts of the impact plate and multiple casing-edge receiving protrusions, in accordance with some examples.
Figure 4E:
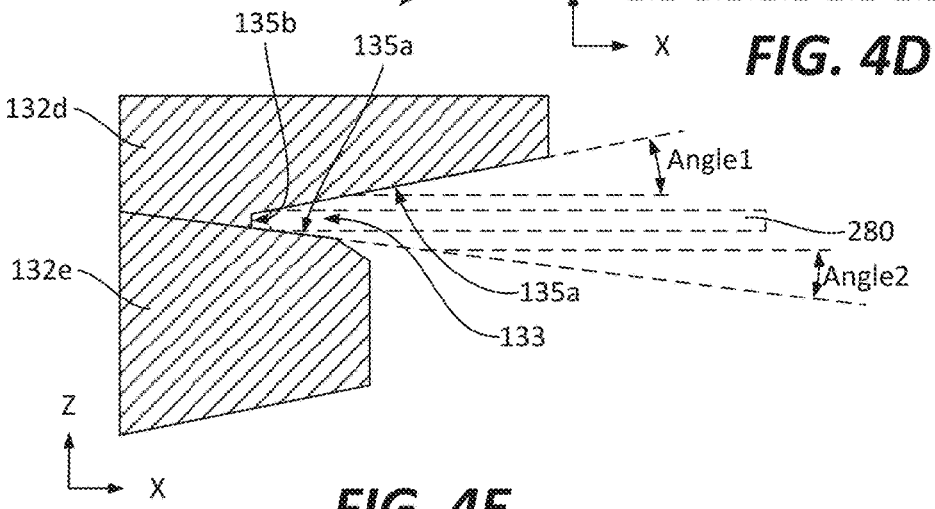
FIG. 4E is an expanded view of one casing-edge receiving protrusion in FIG. 4D, illustrating the two side walls and the bottom wall of the protrusion, in accordance with some examples.
Figure 4F:
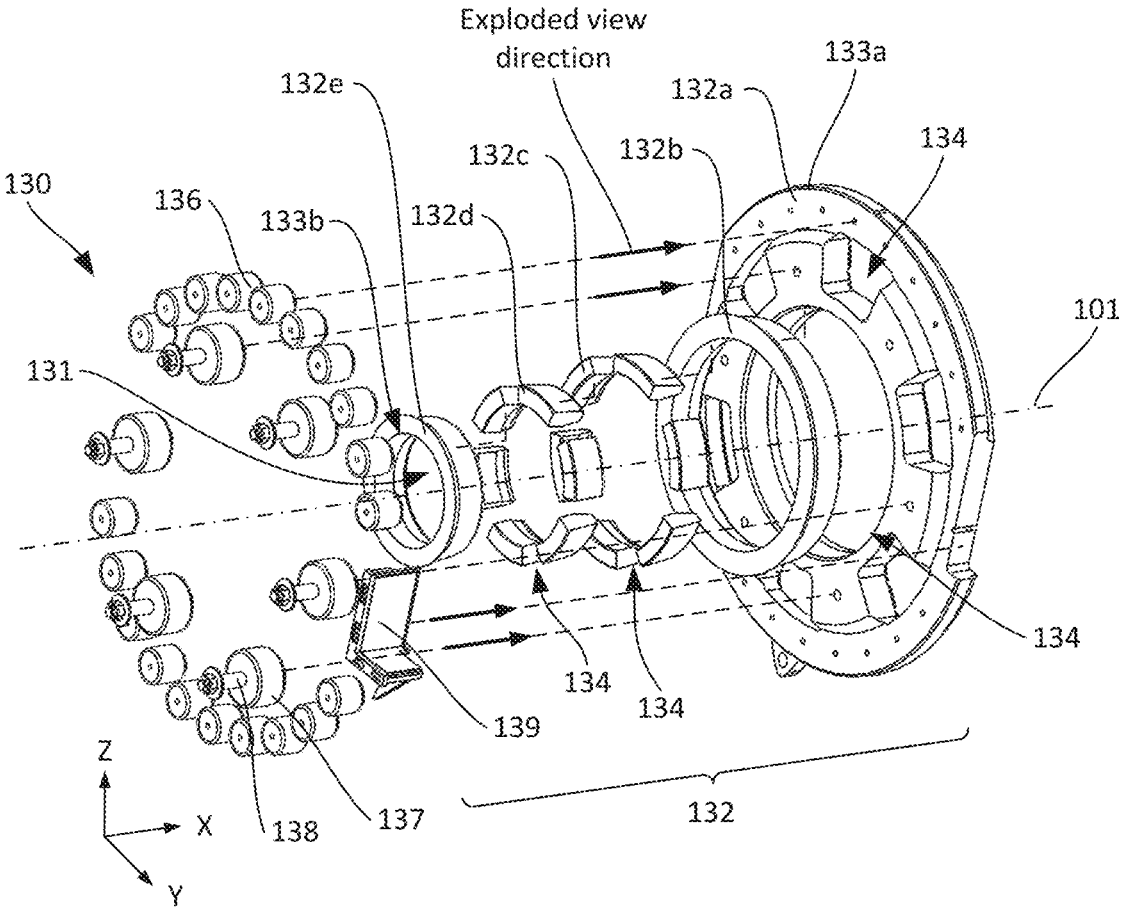
FIG. 4F is an exploded view of the impact plate assembly in FIG. 4A, in accordance with some examples.

Referring to FIGS. 4D and 4F, in some examples, impact plate 132 comprises main impact plate 132*a* and one or more rings (first ring 132*b*, second ring 132*c*, third ring 132*d*, and fourth ring 132*e*), all welded together with a weld 401. Having separate components that are welded together can be used to simplify the manufacturing of impact plate 132. Impact plate 132 may also comprise supporting brackets 139 that are configured to support impact plate 132 or, more specifically, impact plate assembly 130 on the tracks 112.

Referring to FIGS. 4D and 4E, in some examples, impact plate 132 comprises a plurality of casing-edge receiving protrusions 133, each having a circular shape concentric about primary axis 101. Different casing-edge receiving protrusions 133 have different diameters. In other words, each casing-edge receiving protrusion 133 has a different diameter than any other casing-edge receiving protrusion 133. This radial offset ensures that impact plate 132 can accommodate casing/pipes having different diameters.

Referring to FIG. 4E, in some examples, each casing-edge receiving protrusion 133 comprises two sidewalls 135*a*, each angled between 3° and 10° relative to primary axis 101. In some examples, the angles of these sidewalls 135*a* are different. The angles and spacing of sidewalls 135*a* are specifically selected to accommodate the edge of casing/pipe such that this edge is not damaged when a combination of constant and percussive forces are applied to the edge by impact plate 132 or, more specifically, by sidewalls 135*a*. For example, the angles and spacing ensure that the edge remains within the elastic deformation zone while being compressed within casing-edge receiving protrusion 133. Preserving the shape of this edge helps, at later stages, to weld another pipe to this edge.

In some examples, two sidewalls 135*a* extend to bottom wall 135*b* having a width less than the wall thickness of open-ended casing 280 protruding into a corresponding casing-edge receiving protrusion 133. As such, the edge of open-ended casing 280 is not able to reach bottom wall 135*b* and is damaged by the contact with the bottom wall 135*b*.

Figure 3C:
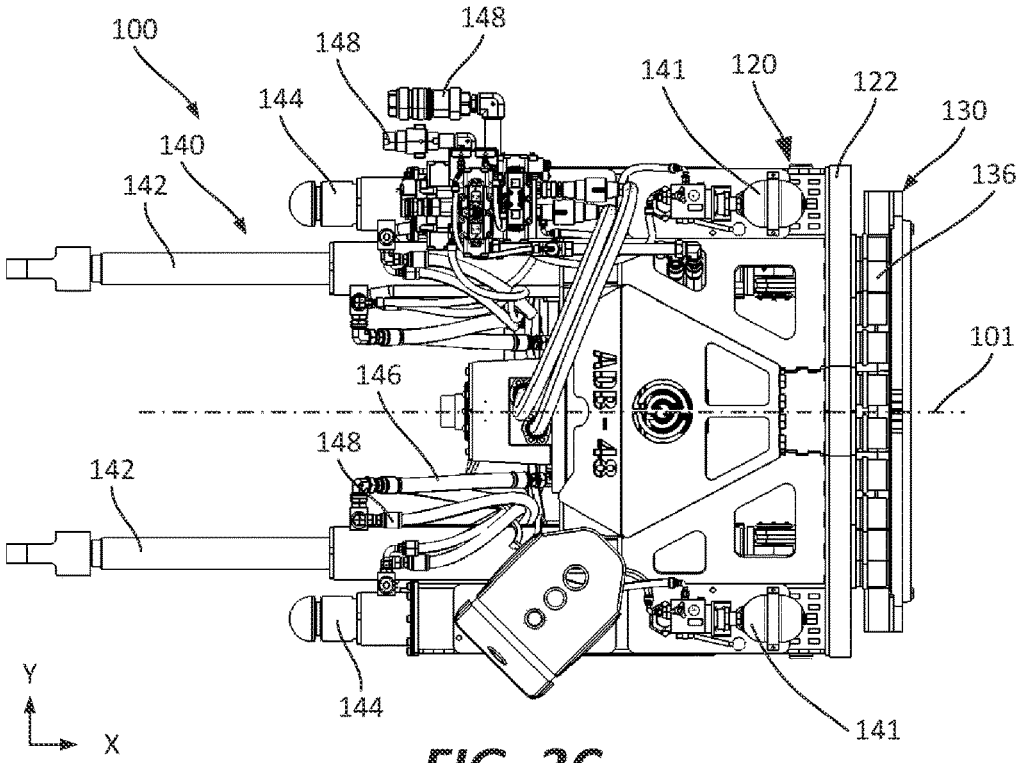
FIG. 3C is a schematic top view of the assembly in FIG. 3A, illustrating the orientation of hydraulic connectors, in accordance with some examples.
Figure 3D:
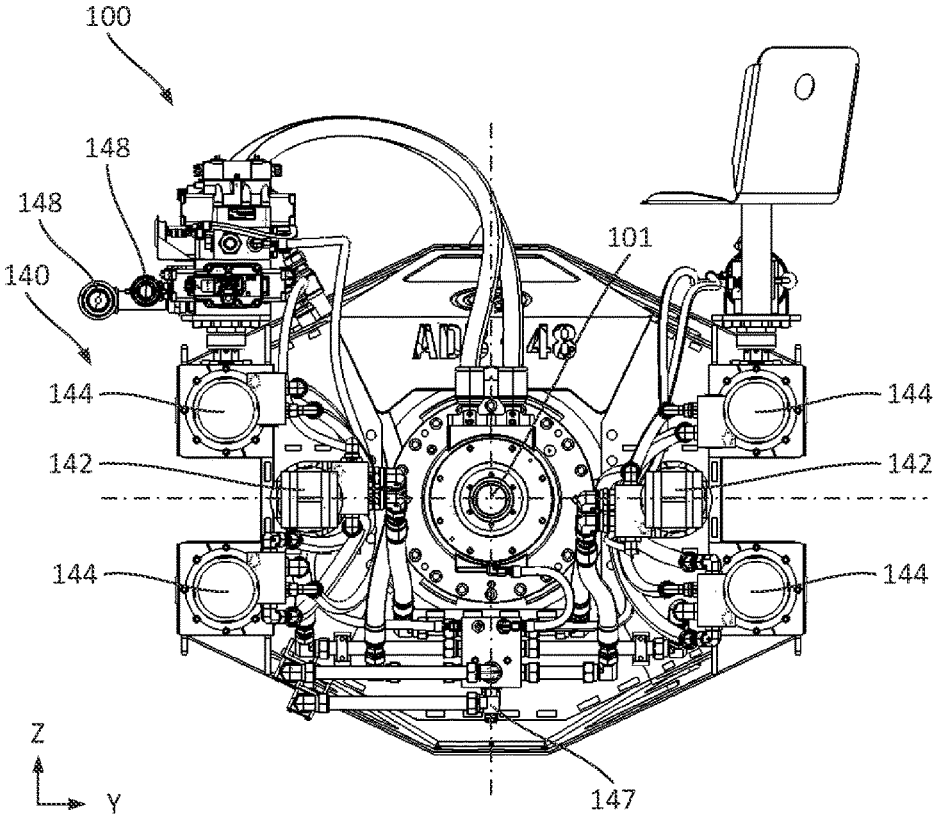
FIG. 3D is a schematic back view of the assembly in FIG. 3A, illustrating the orientation of primary and secondary hydraulic cylinders, in accordance with some examples.

Referring to FIGS. 3C and 3D, in some examples, multi-tool boring system 100 further comprises hydraulic system 140 attached to jacking frame 120 and configured to move jacking frame 120 relative to track assembly 110. Specifically, hydraulic system 140 comprises a set of primary hydraulic cylinders 142 and a set of secondary hydraulic cylinders 144, independently actuatable from the set of primary hydraulic cylinders 142. A combination of these cylinders can be used to achieve high forces, e.g., when all cylinders push in the same direction. Alternatively, deactivating some cylinders (e.g., secondary hydraulic cylinders 144) allows operating the remaining cylinders (e.g., primary hydraulic cylinders 142) at faster displacement rates.

Referring to FIG. 3D, in some examples, the cylinders' positions of primary hydraulic cylinders 142 are symmetrical with respect to primary axis 101. For example, FIG. 3D illustrates primary axis 101 being positioned between two primary hydraulic cylinders 142 (positioned horizontally in this view). In the same or other examples, the cylinders' positions of second hydraulic cylinders 144 are symmetrical with respect to primary axis 101. For example, FIG. 3D illustrates primary axis 101 is positioned between each pair of opposing secondary hydraulic cylinders 144. This symmetrical orientation of primary hydraulic cylinders 142 and second hydraulic cylinders 144 helps to avoid torque on jacking frame 120 and track assembly 110 and to have the majority of forces directed along primary axis 101

Referring to FIG. 3C, in some examples, hydraulic system 140 comprises a set of hydraulic hoses 146 and a set of hydraulic connectors 148, coupled to the set of hydraulic hoses 146. Each cylindrical interface, which is formed by the set of hydraulic connectors 148 and set of hydraulic hoses 146, is aligned substantially parallel to the primary axis 101. This parallel orientation of the interfaces reduces the stress, especially when multi-tool boring system 100 is used with pneumatic rammer 162 that applies percussive forces to impact plate assembly 130. Even though hydraulic system 140 is not directly attached to impact plate assembly 130 and some damping is provided by shock absorbers 136, the hydraulic connections can be sensitive to percussive forces, especially at high frequencies.

In some examples, hydraulic system 140 comprises a set of hydraulic dampers 141, each comprising a gas enclosed fluidically coupled to at least a set of primary hydraulic cylinders 142. These hydraulic dampers 141 help to accommodate percussive forces and not create corresponding force spikes within the hydraulic system 140. For example, hydraulic system 140 or, more specifically, primary hydraulic cylinders 142 and second hydraulic cylinders 144 are used to apply a constant force on jacking frame 120 and subsequently to impact plate assembly 130. At the same time, impact plate assembly 130 is attached to pneumatic rammer 162 which applies percussive forces to impact plate assembly 130. As such, a combination of impact plate assembly 130 and jacking frame 120 can cause some of these percussive forces to be transferred to hydraulic system 140. Since the hydraulic fluid is not compressible, hydraulic system 140 can then propagate these percussive forces to other components of hydraulic system 140. Hydraulic dampers 141 reduce this percussive force propagation by allowing the gas to compress and providing additional space for the hydraulic fluid. In some examples, hydraulic dampers 141.

Referring to FIG. 3D, in some examples, hydraulic system 140 further comprises pressure-relief valve 147 fluidically coupled to hydraulic drive 170 when hydraulic drive 170 is attached to jacking frame 120. Pressure-relief valve 147 prevents excessive torque by hydraulic drive 170, which can cause a fall and/or damage multi-tool boring system 100. For example, hydraulic drive 170 can be used to rotate an auger (e.g., as shown in FIG. 1B). When the auger hits a rock or hard soil, the auger can resist the rotation causing the increase in torque applied by the hydraulic drive 170. If this torque level is not limited, then hydraulic drive 170 can cause the rotation of multi-tool boring system 100 relative to the bore (instead of rotating the auger within the bore).

Figure 7A:
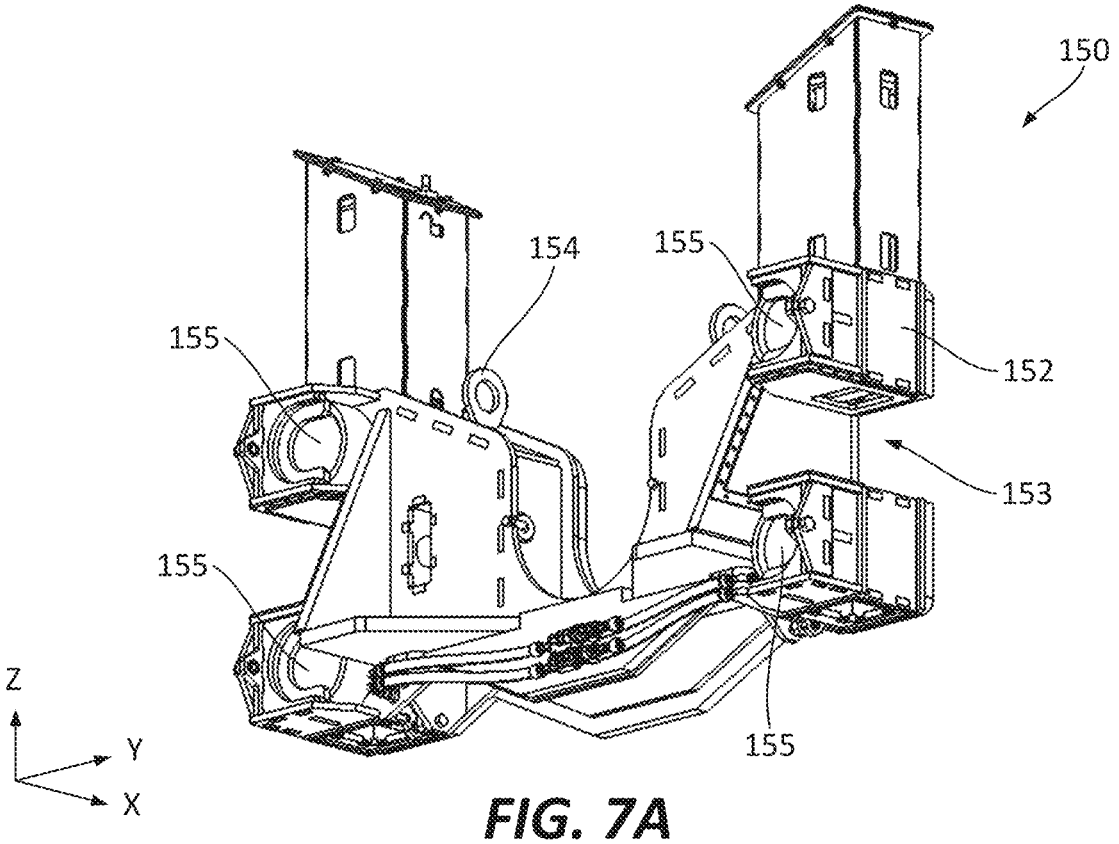
FIGS. 7A and 7B are schematic perspective views of an anchoring unit, in accordance with some examples.
Figure 7B:
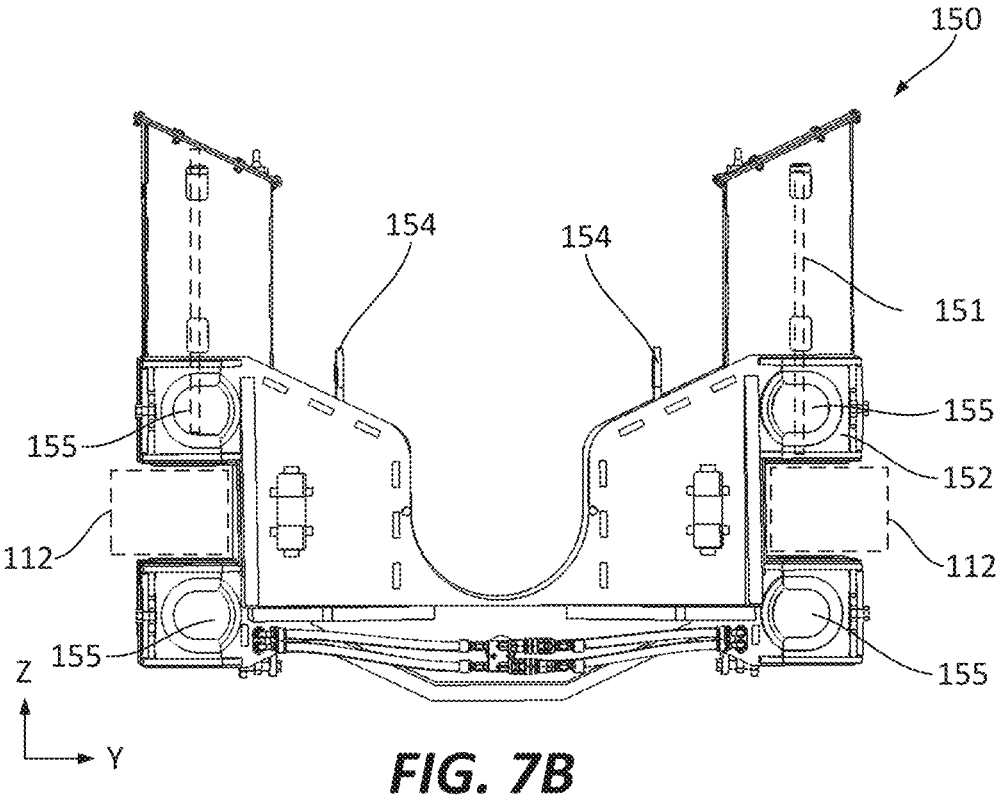

Referring to FIGS. 7A and 7B, in some examples, multi-tool boring system 100 further comprises an anchoring unit 150 configured to form a temporary fixed positioned on two tracks 112. Anchoring unit 150 is used by hydraulic system 140 to push/pull jacking frame 120 relative to track assembly 110. Specifically, anchoring unit 150 comprises primary jack anchors 154 (for attaching primary hydraulic cylinders 142) and secondary jack engagement surfaces 155 (for engaging the ends of second hydraulic cylinders 144). The example shown in FIGS. 7A and 7B, allows primary hydraulic cylinders 142 to push and pull jacking frame 120, while second hydraulic cylinders 144 are only able to push jacking frame 120.

In some examples, anchoring unit 150 comprises a bridging frame 152 forming two frame openings 153 such that each of two tracks 112 extends through one of two frame openings 153. Furthermore, anchoring unit 150 comprises two locking pins 151 that are configured to slide within bridging frame 152 (along the Z-axis in the illustrated view). In an unlocked position, each locking pin 151 is positioned above the tracks 112. In a locked position, each locking pin 151 protrudes into the tracks 112 or, more specifically, through tracks 112.

Figure 8A:
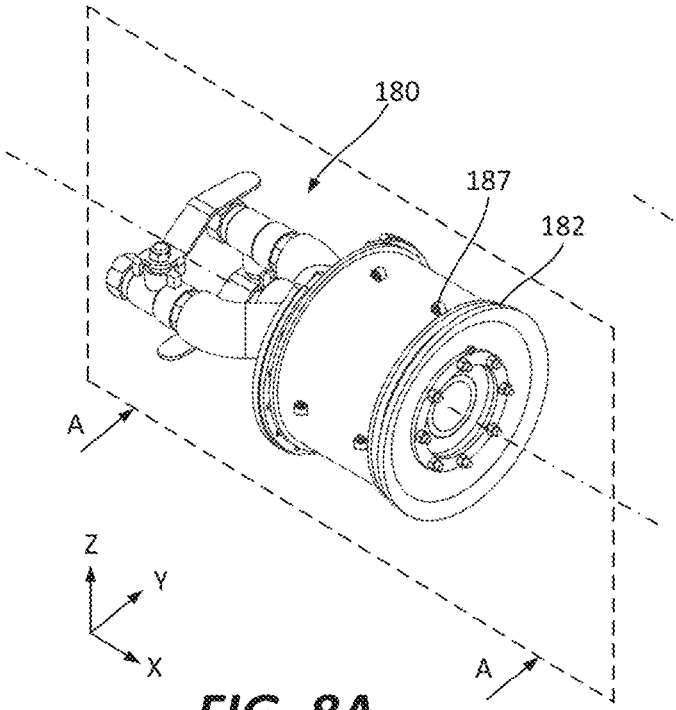
FIGS. 8A and 8B are schematic perspective views of an internal casing plug, in accordance with some examples.
Figure 8B:
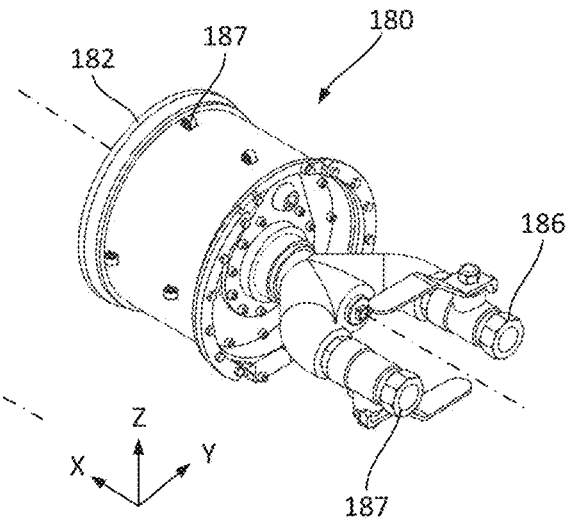
Figure 8C:
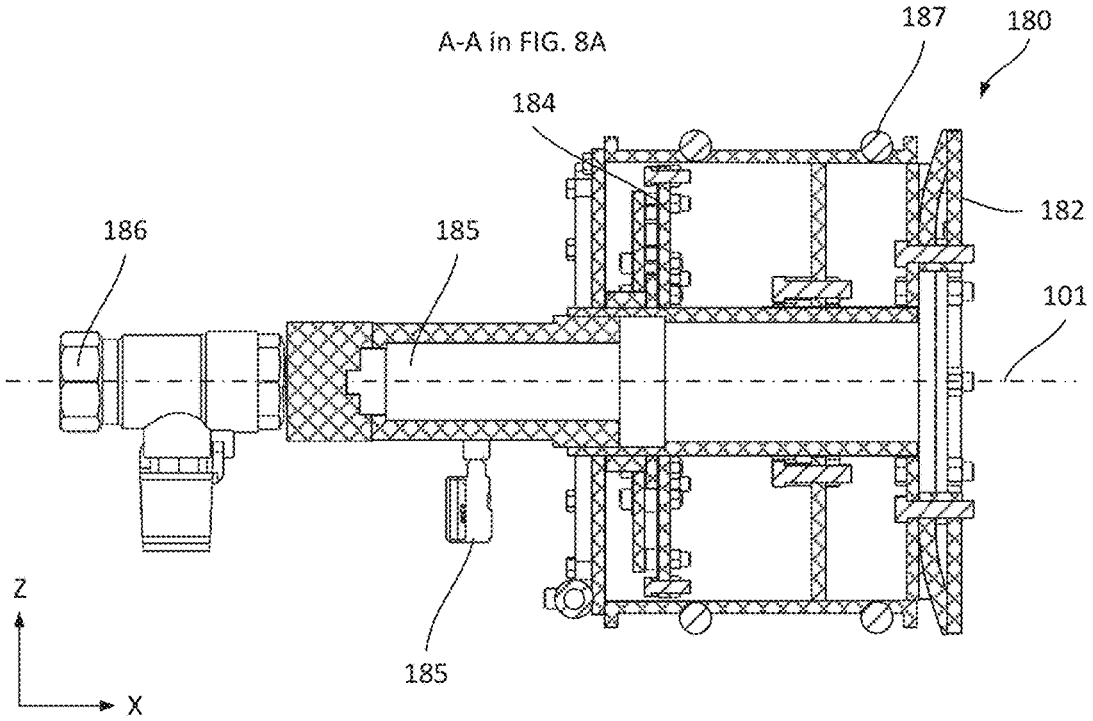
FIG. 8C is a schematic cross-sectional view of the internal casing plug, shown in FIGS. 8A and 8B, in accordance with some examples.

Referring to FIGS. 7A and 7B, in some examples, multi-tool boring system 100 further comprises an internal plug 180, which is used to plug casing/pipe to prevent dirt and in particular water (e.g., when boring with a high water table) from entering the casing. Referring to FIGS. 8A, 8B, and 8C, in some examples, internal plug 180 comprises a set of valves 186 and 187 used to remove and supply water through internal plug 180. Internal plug 180 also comprises seal 182 for sealing the plug within the casing. Gearing mechanism 184 allows a central stem to move back and forth, a retaining plate, and a structural frame to restrain the motion of the central moveable part. Channel 185 allows for the water to be let out by the relief valves at the back. In some examples, internal plug 180 comprises a pressure gauge, which indicates if there is any water coming out. For example, if this back pressure is at a zero level, internal plug 180 can be removed (e.g., in order to use an auger through the pipe). In this situation, the dirt (e.g., clay) creates its own plug equivalent. Overall, internal plug 180 can be used for determining water conditions within the bore, e.g., (1) when no water is coming out and the pressure gauge is at a zero level, the conditions are such that internal plug 180 can be removed and the operation can switch to auguring or hand mining; (2) when no water is coming, but the pressure level is high; these conditions are indicative of a water wall, which complicates further boring; in these situations, a valve can be opened to let some water out; (3) excessive amounts of water are coming from internal plug 180 can result in a sink hole at the boring location.

Figure 9A:
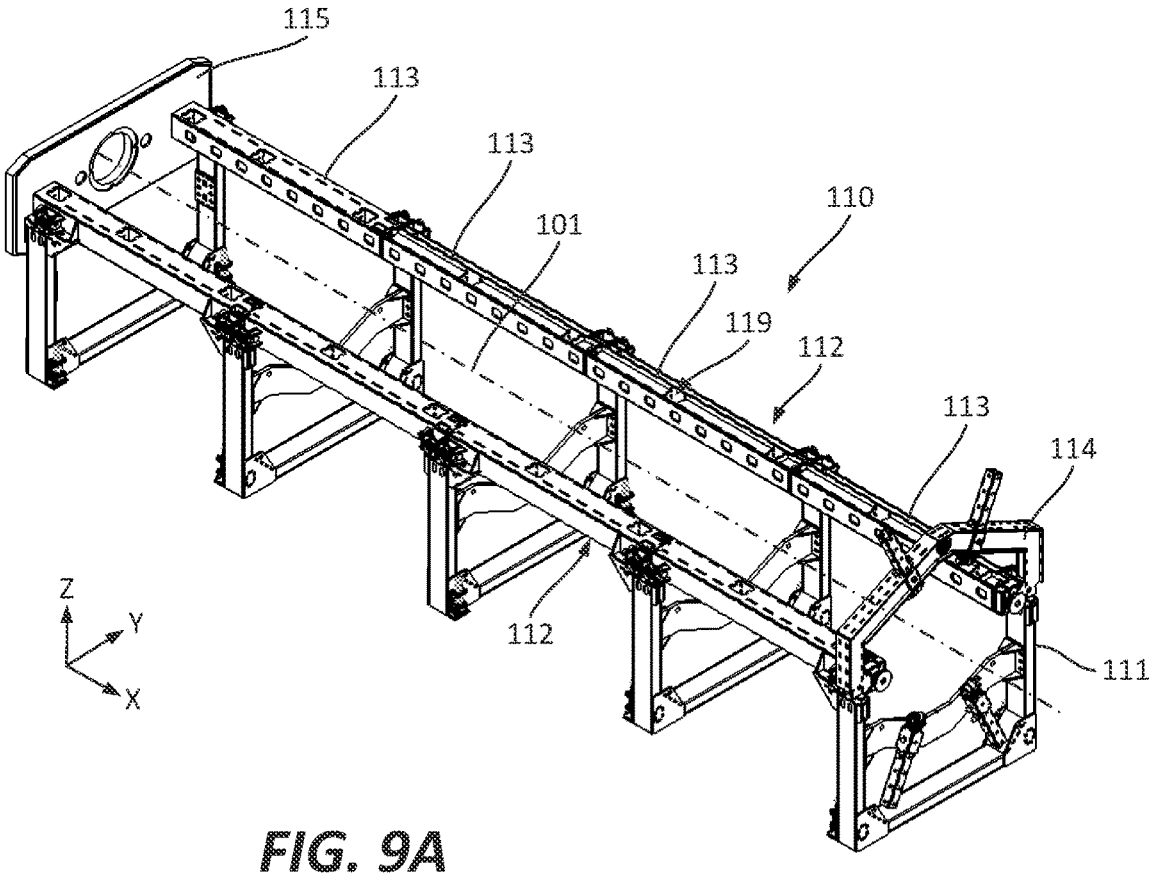
FIG. 9A is a schematic perspective view of a frame assembly comprising tracks, formed by track units and supported by track legs, in accordance with some examples.
Figure 9B:
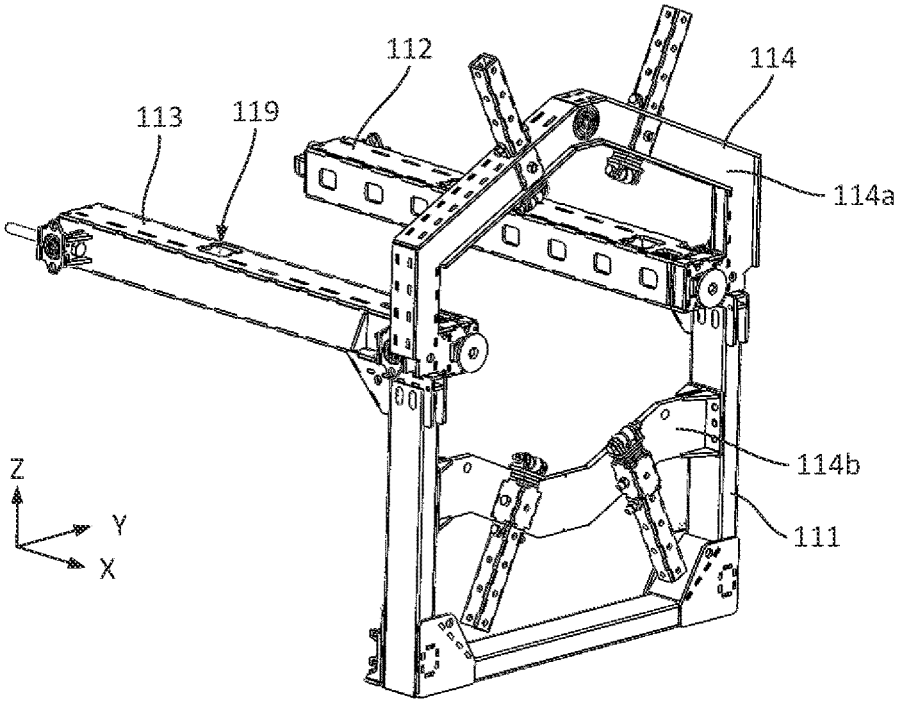
FIG. 9B is a schematic perspective view of a frame sub-assembly used for casing support, in accordance with some examples.
Figure 9C:
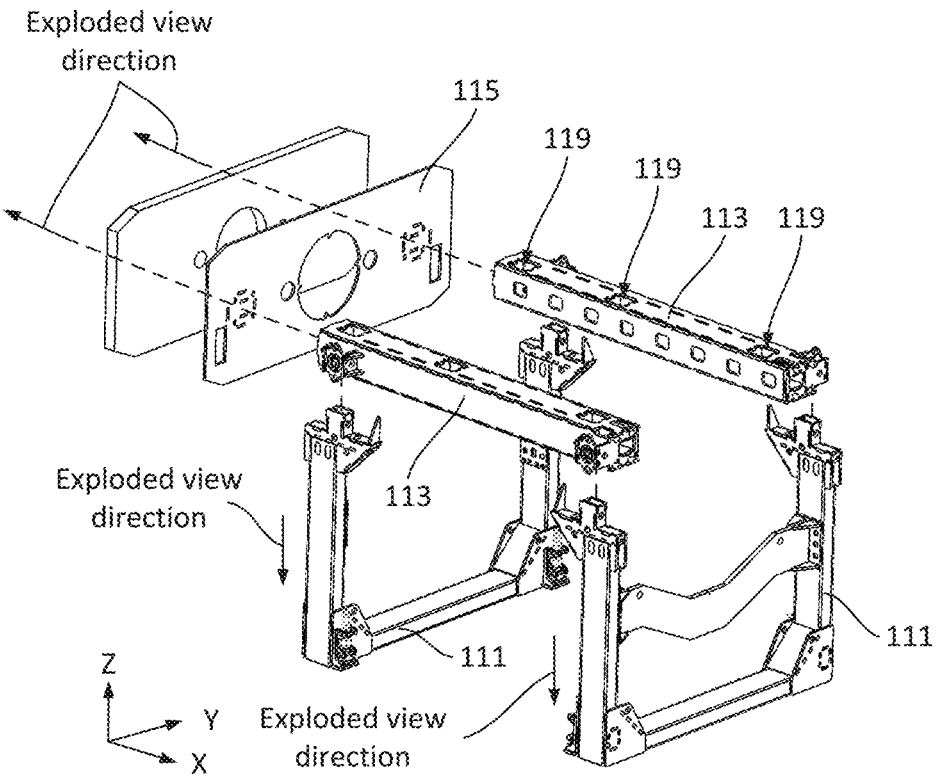
FIG. 9C is a schematic perspective view of a frame sub-assembly comprising a back plate, in accordance with some examples.

Referring to FIGS. 9A-9C, in some examples, each track 112 comprises a set of track units 113, extending along primary axis 101. Each adjacent pair of track units 113 is bolted together by a set of bolts (e.g., four internal bolts and one external bolt). This modular approach allows forming tracks 112 of any length, e.g., to accommodate different pipe lengths without occupying excessive spaces in front of the boring opening. Tracks 112 or, more specifically, track units 113 have multiple protrusions 119 used for locking anchoring unit 150, e.g., protruding locking pins 151. Track assembly 110 further comprises a set of track support 111 configured to support two tracks 112 relative to each other and relative to the ground. Each end of each track unit in a set of track units 113 is supported by one in a set of track support 111. Furthermore, track assembly 110 can comprise casing-support unit 114, comprising first subunit 114*a* (e.g., attached to track units 113) and second subunit 114*b* (e.g., attached to or a part of track support 111). In some examples, track assembly 110 also comprises back plate 115.

Examples of Operating Multi-Tool Boring Systems

Figure 10:
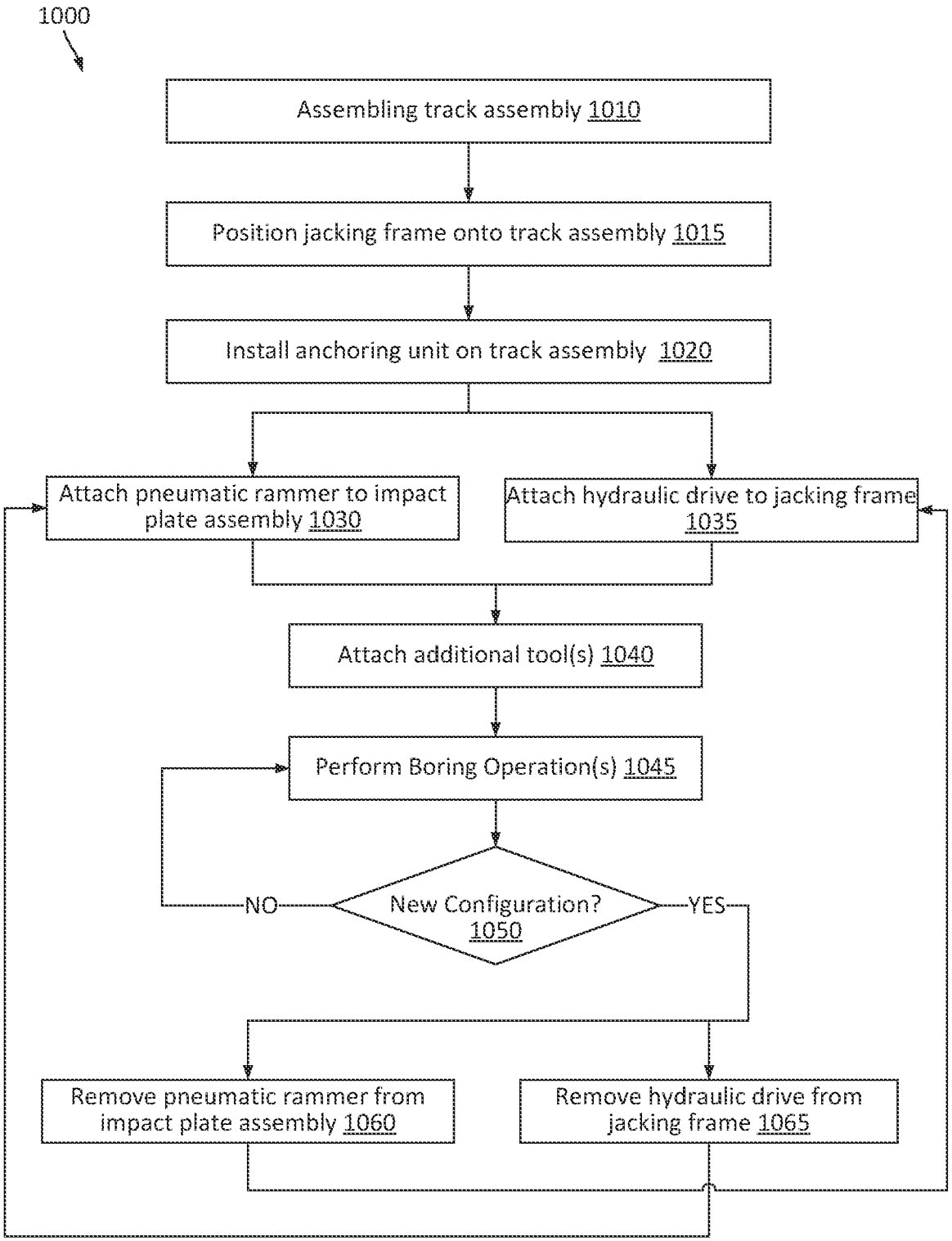
FIG. 10 is a process flowchart corresponding to a method of operating a multi-tool boring system, in accordance with some examples.

FIG. 10 is a process flowchart corresponding to method 1000 of operating multi-tool boring system 100, in accordance with some examples. Various examples and features of multi-tool boring system 100 are described above.

In some examples, method 1000 comprises (block 1010) assembling track assembly 110. The modular configuration of the track assembly 110 allows forming different lengths of the track assembly 110, e.g., to accommodate different workspaces and pipe lengths. For example, this operation can involve bolting together different portions of track units 113.

In some examples, method 1000 comprises (block 1015) positioning jacking frame 120 onto track assembly 110. For example, two tracks 112 can protrude through specific slider openings within jacking frame 120.

In some examples, method 1000 comprises (block 1020) installing anchoring unit 150 on track assembly 110. As noted above, anchoring unit 150 engages hydraulic system 140 or, more specifically, primary hydraulic cylinders 142 and second hydraulic cylinders 144, thereby enabling hydraulic system 140 to push or pull jacking frame 120 on track assembly 110 and along primary axis 101. Depending on the length of tracks 112 and the operating distance of hydraulic system 140, anchoring unit 150 can be reinstalled at different positions along tracks 112.

In some examples, method 1000 comprises (block 1030) attaching pneumatic rammer 162 to impact plate assembly 130 or (block 1035) attaching hydraulic drive 170 to jacking frame 120. In some examples, method 1000 comprises (block 1040) attaching various additional tools, some examples of which are described above with reference to FIGS. 1A-1F. In some examples, method 1000 comprises (block 1045) one or more boring operations, some examples of which are described above with reference to FIGS. 1A-1F. If a new system configuration is needed (decision block 1050), method 1000 can proceed with (block 1060) removing pneumatic rammer 162 from impact plate assembly 130 and/or (block 1065) removing hydraulic drive 170 from jacking frame 120.

CONCLUSION

Although the foregoing concepts have been described in some detail for purposes of clarity of understanding, it will be apparent that certain changes and modifications may be practiced within the scope of the appended claims. It should be noted that there are many alternative ways of implementing processes, systems, and apparatuses. Accordingly, the present embodiments are to be considered illustrative and not restrictive.

What is claimed is:

1. A multi-tool boring system comprising:

a track assembly comprising two tracks extending parallel to a primary axis of the multi-tool boring system;

a jacking frame slidably supported on the track assembly, wherein the jacking frame comprises a pair of drive supporting plates, each extending substantially perpendicular to the primary axis such that a hydraulic drive is configured to bolt to each of the drive supporting plates when the hydraulic drive is attached to the jacking frame and when a pneumatic rammer is removed from the multi-tool boring system; and an impact plate assembly attached to the jacking frame, wherein:

the impact plate assembly comprises an impact plate and a plurality of shock absorbers forming a ring positioned between the impact plate and the jacking frame along an outer edge of the impact plate, and the impact plate comprises an impact plate opening defined by an inner edge, configured to engage and support the pneumatic rammer when the pneumatic rammer is attached to the impact plate and partially protrudes into the impact plate opening.

2. The multi-tool boring system of claim 1, wherein the inner edge formed a cone-shaped surface symmetrical about the primary axis.

3. The multi-tool boring system of claim 1, wherein:

each of the pair of drive supporting plates comprises a plate opening, the hydraulic drive protrudes through the plate opening of each of the pair of drive supporting plates when the hydraulic drive is attached to the jacking frame, and the pneumatic rammer protrudes through the plate opening of each of the pair of drive-supporting plates when the pneumatic rammer is attached to the impact plate.

4. The multi-tool boring system of claim 1, wherein the impact plate comprises a main plate and one or more rings, and wherein the main plate and the one or more rings are all welded together.

5. The multi-tool boring system of claim 1, further comprising a hydraulic system attached to the jacking frame and configured to move the jacking frame relative to the track assembly, wherein the hydraulic system comprises a set of primary hydraulic cylinders and a set of secondary hydraulic cylinders, and wherein the set of secondary hydraulic cylinders is independently actuatable from the set of primary hydraulic cylinders.

6. The multi-tool boring system of claim 5, wherein:

position of each primary hydraulic cylinder in the set of primary hydraulic cylinders are symmetrical with respect to the primary axis; and position of each secondary hydraulic cylinder in the set of secondary hydraulic cylinders are symmetrical with respect to the primary axis.

7. The multi-tool boring system of claim 5, wherein:

the hydraulic system comprises a set of hydraulic hoses and a set of hydraulic connectors coupled to the set of hydraulic hoses; and any cylindrical interface formed by the set of hydraulic connectors and the set of hydraulic hoses is aligned substantially parallel to the primary axis.

8. The multi-tool boring system of claim 5, wherein the hydraulic system further comprises a pressure-relief valve fluidically coupled to a hydraulic drive when the hydraulic drive is attached to the jacking frame.

9. The multi-tool boring system of claim 1, wherein each of the two tracks comprises a set of track units extending along the primary axis such that each adjacent pair of the set of track units is bolted together.

10. The multi-tool boring system of claim 9, wherein:

the track assembly further comprises a set of track support configured to support the two tracks relative to each other and relative to ground, and each end of each track unit in the set of track units is supported by one in the set of track support.

11. A multi-tool boring system comprising:

a track assembly comprising two tracks extending parallel to a primary axis of the multi-tool boring system;

a jacking frame slidably supported on the track assembly; and an impact plate assembly attached to the jacking frame, wherein:

the impact plate assembly comprises an impact plate and a plurality of shock absorbers positioned between the impact plate and the jacking frame along an outer edge of the impact plate, the impact plate comprises an impact plate opening defined by an inner edge, configured to engage and support a pneumatic rammer when the pneumatic rammer is attached to the impact plate and partially protrudes into the impact plate opening, the impact plate assembly further comprises a plurality of additional shock absorbers and a plurality of supporting bolts such that each of the plurality of supporting bolts protrudes through one of the plurality of additional shock absorbers and such that each of the plurality of additional shock absorbers is positioned closer to the primary axis than any one of the plurality of shock absorbers, and the jacking frame comprises a frame plate such that the plurality of shock absorbers and the plurality of additional shock absorbers are disposed between and in contact with each of the impact plate and the frame plate and such that the plurality of supporting bolts is bolted into the frame plate.

12. A multi-tool boring system comprising:

a track assembly comprising two tracks extending parallel to a primary axis of the multi-tool boring system;

a jacking frame slidably supported on the track assembly; and an impact plate assembly attached to the jacking frame, wherein:

the impact plate assembly comprises an impact plate and a plurality of shock absorbers positioned between the impact plate and the jacking frame along an outer edge of the impact plate, the impact plate comprises an impact plate opening defined by an inner edge, configured to engage and support a pneumatic rammer when the pneumatic rammer is attached to the impact plate and partially protrudes into the impact plate opening, and the impact plate comprises dirt removal passages circumferentially distributed about the primary axis.

13. The multi-tool boring system of claim 12, wherein the dirt removal passages comprise multiple sets of the dirt removal passages having different radial offsets from the primary axis.

14. A multi-tool boring system comprising:

a track assembly comprising two tracks extending parallel to a primary axis of the multi-tool boring system;

a jacking frame slidably supported on the track assembly; and an impact plate assembly attached to the jacking frame, wherein:

the impact plate assembly comprises an impact plate and a plurality of shock absorbers positioned between the impact plate and the jacking frame along an outer edge of the impact plate, the impact plate comprises an impact plate opening defined by an inner edge, configured to engage and support a pneumatic rammer when the pneumatic rammer is attached to the impact plate and partially protrudes into the impact plate opening, and the impact plate comprises a plurality of casing-edge receiving protrusions, each having a circular shape concentric about the primary axis and having a different diameter than any other one of the plurality of casing-edge receiving protrusions.

15. The multi-tool boring system of claim 14, wherein each of the plurality of casing-edge receiving protrusions comprises two side walls, each of the two side walls angled between 3° and 10° relative to the primary axis.

16. The multi-tool boring system of claim 15, wherein an angle of one of the two side walls is different from an angle of another one of the two side walls.

17. The multi-tool boring system of claim 15, wherein the two side walls extend to a bottom wall, wherein the bottom wall has a width less than a wall thickness of an open-ended casing protruding into a corresponding one of the plurality of casing-edge receiving protrusions.

18. A multi-tool boring system comprising:

a track assembly comprising two tracks extending parallel to a primary axis of the multi-tool boring system;

a jacking frame slidably supported on the track assembly; and an impact plate assembly attached to the jacking frame, wherein:

the impact plate assembly comprises an impact plate and a plurality of shock absorbers positioned between the impact plate and the jacking frame along an outer edge of the impact plate, the impact plate comprises an impact plate opening defined by an inner edge, configured to engage and support a pneumatic rammer when the pneumatic rammer is attached to the impact plate and partially protrudes into the impact plate opening, a hydraulic system attached to the jacking frame and configured to move the jacking frame relative to the track assembly, wherein:

the hydraulic system comprises a set of primary hydraulic cylinders and a set of secondary hydraulic cylinders, the set of secondary hydraulic cylinders is independently actuatable from the set of primary hydraulic cylinders, the hydraulic system comprises a set of hydraulic dampers, each comprising a gas, and the gas is enclosed and fluidically coupled to at least the set of primary hydraulic cylinders and is configured to accommodate percussive forces and not create corresponding force spikes within the hydraulic system.

19. A multi-tool boring system comprising:

a track assembly comprising two tracks extending parallel to a primary axis of the multi-tool boring system;

a jacking frame slidably supported on the track assembly; and an impact plate assembly attached to the jacking frame, wherein:

the impact plate assembly comprises an impact plate and a plurality of shock absorbers positioned between the impact plate and the jacking frame along an outer edge of the impact plate, the impact plate comprises an impact plate opening defined by an inner edge, configured to engage and support a pneumatic rammer when the pneumatic rammer is attached to the impact plate and partially protrudes into the impact plate opening; and an anchoring unit configured to form a temporary fixed position on the two tracks, wherein:

the anchoring unit comprises a bridging frame forming two frame openings such that each of the two tracks extends through one of the two frame openings, and the anchoring unit comprises two locking mechanisms.

* * * * *